US008986187B2

(12) United States Patent
Perkins et al.

(10) Patent No.: US 8,986,187 B2
(45) Date of Patent: Mar. 24, 2015

(54) OPTICALLY COUPLED COCHLEAR ACTUATOR SYSTEMS AND METHODS

(71) Applicant: Earlens Corporation, Redwood City, CA (US)

(72) Inventors: Rodney C. Perkins, Woodside, CA (US); Sunil Puria, Sunnyvale, CA (US)

(73) Assignee: Earlens Corporation, Menlo Park, CA (US)

( * ) Notice: Subject to any disclaimer, the term of this patent is extended or adjusted under 35 U.S.C. 154(b) by 0 days.

(21) Appl. No.: 14/218,461

(22) Filed: Mar. 18, 2014

(65) Prior Publication Data

US 2014/0275734 A1 Sep. 18, 2014

Related U.S. Application Data

(63) Continuation of application No. 12/822,801, filed on Jun. 24, 2010, now Pat. No. 8,715,154.

(60) Provisional application No. 61/219,861, filed on Jun. 24, 2009.

(51) Int. Cl.
*H04R 25/00* (2006.01)
*H04R 23/00* (2006.01)

(52) U.S. Cl.
CPC ..... *H04R 25/606* (2013.01); *H04R 23/008* (2013.01); *H04R 25/554* (2013.01); *H04R 2225/023* (2013.01)
USPC ..... 600/25

(58) Field of Classification Search
USPC ..... 600/25, 126; 381/23.1, 312, 68; 607/55, 607/56, 137, 57; 181/129
See application file for complete search history.

(56) References Cited

U.S. PATENT DOCUMENTS 3,209,082 A 9/1965 McCarrell et al.
3,440,314 A 4/1969 Frisch
3,549,818 A 12/1970 Turner et al.

(Continued)

FOREIGN PATENT DOCUMENTS

DE 2044870 A1 3/1972
DE 3243850 A1 5/1984

(Continued)

OTHER PUBLICATIONS

Mah, "Fundamentals of Photovoltaic Materials", National Solar Power Research Institute, Inc. Dec. 21, 1998, pp. 3-9.*

(Continued)

*Primary Examiner* — John Lacyk
(74) *Attorney, Agent, or Firm* — Wilson Sonsini Goodrich & Rosati

(57) ABSTRACT

A transducer is configured to couple to the cochlear fluid so as to transmit sound with low amounts of energy, such that feed back to a microphone positioned in the ear canal is inhibited substantially. The cochlear fluid coupled hearing device can allow a user to determine from which side a sound originates with vibration of the cochlea and the user can also receive sound localization cues from the device, as feedback can be substantially inhibited. The transducer may be coupled to the cochlear fluid with a thin membrane disposed between the transducer and the cochlear fluid, for example with a fenestration in the cochlea. In some embodiments, a support coupled to the transducer directly contacts the fluid of the cochlea so as to couple the transducer to the cochlear fluid.

22 Claims, 10 Drawing Sheets

(56) References Cited

U.S. PATENT DOCUMENTS 3,585,416 A 6/1971 Mellen
3,594,514 A 7/1971 Wingrove
3,710,399 A 1/1973 Hurst
3,712,962 A 1/1973 Epley
3,764,748 A 10/1973 Branch et al.
3,808,179 A 4/1974 Gaylord
3,882,285 A 5/1975 Nunley et al.
3,985,977 A 10/1976 Beaty et al.
4,002,897 A 1/1977 Kleinman et al.
4,061,972 A 12/1977 Burgess
4,075,042 A 2/1978 Das
4,098,277 A 7/1978 Mendell
4,109,116 A 8/1978 Victoreen
4,120,570 A 10/1978 Gaylord
4,248,899 A 2/1981 Lyon et al.
4,252,440 A 2/1981 Frosch et al.
4,303,772 A 12/1981 Novicky
4,319,359 A 3/1982 Wolf
4,334,315 A 6/1982 Ono et al.
4,334,321 A 6/1982 Edelman
4,339,954 A 7/1982 Anson et al.
4,357,497 A 11/1982 Hochmair et al.
4,380,689 A 4/1983 Giannetti
4,428,377 A 1/1984 Zollner et al.
4,524,294 A 6/1985 Brody
4,540,761 A 9/1985 Kawamura et al.
4,556,122 A 12/1985 Goode
4,592,087 A 5/1986 Killion
4,606,329 A 8/1986 Hough
4,611,598 A 9/1986 Hortmann et al.
4,628,907 A 12/1986 Epley
4,641,377 A 2/1987 Rush et al.
4,654,554 A 3/1987 Kishi
4,689,819 A 8/1987 Killion
4,696,287 A 9/1987 Hortmann et al.
4,729,366 A 3/1988 Schaefer
4,741,339 A 5/1988 Harrison et al.
4,742,499 A 5/1988 Butler
4,756,312 A 7/1988 Epley
4,766,607 A 8/1988 Feldman
4,774,933 A 10/1988 Hough et al.
4,776,322 A 10/1988 Hough et al.
4,782,818 A 11/1988 Mori
4,800,884 A 1/1989 Heide et al.
4,800,982 A 1/1989 Carlson
4,817,607 A 4/1989 Tatge
4,840,178 A 6/1989 Heide et al.
4,845,755 A 7/1989 Busch et al.
4,865,035 A 9/1989 Mori
4,932,405 A 6/1990 Peeters et al.
4,936,305 A 6/1990 Ashtiani et al.
4,944,301 A 7/1990 Widin et al.
4,948,855 A 8/1990 Novicky
4,957,478 A 9/1990 Maniglia
4,999,819 A 3/1991 Newnham et al.
5,003,608 A 3/1991 Carlson
5,012,520 A 4/1991 Steeger
5,015,224 A 5/1991 Mariglia
5,015,225 A 5/1991 Hough et al.
5,031,219 A 7/1991 Ward et al.
5,061,282 A 10/1991 Jacobs
5,066,091 A 11/1991 Stoy et al.
5,094,108 A 3/1992 Kim et al.
5,117,461 A 5/1992 Moseley
5,142,186 A 8/1992 Cross et al.
5,163,957 A 11/1992 Sade et al.
5,167,235 A 12/1992 Seacord et al.
5,201,007 A 4/1993 Ward et al.
5,259,032 A 11/1993 Perkins et al.
5,272,757 A 12/1993 Scofield et al.
5,276,910 A 1/1994 Buchele
5,277,694 A 1/1994 Leysieffer et al.
5,360,388 A 11/1994 Spindel et al.
5,378,933 A 1/1995 Pfannenmueller et al.
5,402,496 A 3/1995 Soli et al.
5,411,467 A 5/1995 Hortmann et al.
5,425,104 A 6/1995 Shennib
5,440,082 A 8/1995 Claes
5,440,237 A 8/1995 Brown et al.
5,455,994 A 10/1995 Termeer et al.
5,456,654 A 10/1995 Ball
5,531,787 A 7/1996 Lesinski et al.
5,531,954 A 7/1996 Heide et al.
5,535,282 A 7/1996 Luca
5,554,096 A 9/1996 Ball
5,558,618 A 9/1996 Maniglia
5,572,594 A 11/1996 Devoe et al.
5,606,621 A 2/1997 Reiter et al.
5,624,376 A 4/1997 Ball et al.
5,707,338 A 1/1998 Adams et al.
5,715,321 A 2/1998 Andrea et al.
5,721,783 A 2/1998 Anderson
5,722,411 A 3/1998 Suzuki et al.
5,729,077 A 3/1998 Newnham et al.
5,740,258 A 4/1998 Goodwin-Johansson
5,749,912 A 5/1998 Zhang et al.
5,762,583 A 6/1998 Adams et al.
5,772,575 A 6/1998 Lesinski et al.
5,774,259 A 6/1998 Saitoh et al.
5,782,744 A 7/1998 Money
5,788,711 A 8/1998 Lehner et al.
5,795,287 A 8/1998 Ball et al.
5,797,834 A 8/1998 Goode
5,800,336 A 9/1998 Ball et al.
5,804,109 A 9/1998 Perkins
5,804,907 A 9/1998 Park et al.
5,814,095 A 9/1998 Muller et al.
5,825,122 A 10/1998 Givargizov et al.
5,836,863 A 11/1998 Bushek et al.
5,842,967 A 12/1998 Kroll
5,857,958 A 1/1999 Ball et al.
5,859,916 A 1/1999 Ball et al.
5,879,283 A 3/1999 Adams et al.
5,888,187 A 3/1999 Jaeger et al.
5,897,486 A 4/1999 Ball et al.
5,899,847 A 5/1999 Adams et al.
5,900,274 A 5/1999 Chatterjee et al.
5,906,635 A 5/1999 Maniglia
5,913,815 A 6/1999 Ball et al.
5,922,077 A 7/1999 Espy et al.
5,940,519 A 8/1999 Kuo
5,949,895 A 9/1999 Ball et al.
5,984,859 A 11/1999 Lesinski
5,987,146 A 11/1999 Pluvinage et al.
6,005,955 A 12/1999 Kroll et al.
6,024,717 A 2/2000 Ball et al.
6,045,528 A 4/2000 Arenberg et al.
6,050,933 A 4/2000 Bushek et al.
6,068,589 A 5/2000 Neukermans
6,068,590 A 5/2000 Brisken
6,084,975 A 7/2000 Perkins
6,093,144 A 7/2000 Jaeger et al.
6,137,889 A 10/2000 Shennib et al.
6,139,488 A 10/2000 Ball
6,153,966 A 11/2000 Neukermans
6,174,278 B1 1/2001 Jaeger et al.
6,181,801 B1 1/2001 Puthuff et al.
6,190,305 B1 2/2001 Ball et al.
6,190,306 B1 2/2001 Kennedy
6,208,445 B1 3/2001 Reime
6,217,508 B1 4/2001 Ball et al.
6,222,302 B1 4/2001 Imada et al.
6,222,927 B1 4/2001 Feng et al.
6,240,192 B1 5/2001 Brennan et al.
6,241,767 B1 6/2001 Stennert et al.
6,261,224 B1 7/2001 Adams et al.
6,277,148 B1 8/2001 Dormer
6,312,959 B1 11/2001 Datskos
6,339,648 B1 1/2002 McIntosh et al.
6,354,990 B1 3/2002 Juneau et al.
6,366,863 B1 4/2002 Bye et al.
6,385,363 B1 5/2002 Rajic et al.
6,387,039 B1 5/2002 Moses
6,393,130 B1 5/2002 Stonikas et al.

(56) References Cited

U.S. PATENT DOCUMENTS

| | | | |
|---|---|---|---|
| 6,422,991 | B1 | 7/2002 | Jaeger |
| 6,432,248 | B1 | 8/2002 | Popp et al. |
| 6,436,028 | B1 | 8/2002 | Dormer |
| 6,438,244 | B1 | 8/2002 | Juneau et al. |
| 6,445,799 | B1 | 9/2002 | Taenzer et al. |
| 6,473,512 | B1 | 10/2002 | Juneau et al. |
| 6,475,134 | B1 | 11/2002 | Ball et al. |
| 6,491,644 | B1 | 12/2002 | Vujanic et al. |
| 6,493,453 | B1 | 12/2002 | Glendon |
| 6,493,454 | B1 | 12/2002 | Loi et al. |
| 6,498,858 | B2 | 12/2002 | Kates |
| 6,519,376 | B2 | 2/2003 | Biagi et al. |
| 6,536,530 | B2 | 3/2003 | Schultz et al. |
| 6,537,200 | B2 | 3/2003 | Leysieffer et al. |
| 6,549,633 | B1 | 4/2003 | Westermann |
| 6,554,761 | B1 | 4/2003 | Puria et al. |
| 6,575,894 | B2 | 6/2003 | Leysieffer et al. |
| 6,592,513 | B1 | 7/2003 | Kroll et al. |
| 6,603,860 | B1 | 8/2003 | Taezner et al. |
| 6,620,110 | B2 | 9/2003 | Schmid |
| 6,626,822 | B1 | 9/2003 | Jaeger et al. |
| 6,629,922 | B1 | 10/2003 | Puria et al. |
| 6,668,062 | B1 | 12/2003 | Luo et al. |
| 6,676,592 | B2 | 1/2004 | Ball et al. |
| 6,695,943 | B2 | 2/2004 | Juneau et al. |
| 6,724,902 | B1 | 4/2004 | Shennib et al. |
| 6,728,024 | B2 | 4/2004 | Ribak |
| 6,735,318 | B2 | 5/2004 | Cho |
| 6,754,358 | B1 | 6/2004 | Boesen et al. |
| 6,754,537 | B1 | 6/2004 | Harrison et al. |
| 6,801,629 | B2 | 10/2004 | Brimhall et al. |
| 6,829,363 | B2 | 12/2004 | Sacha |
| 6,842,647 | B1 | 1/2005 | Griffith et al. |
| 6,888,949 | B1 | 5/2005 | Vanden Berghe et al. |
| 6,900,926 | B2 | 5/2005 | Ribak |
| 6,912,289 | B2 | 6/2005 | Vonlanthen et al. |
| 6,920,340 | B2 | 7/2005 | Laderman |
| 6,940,989 | B1 | 9/2005 | Shennib et al. |
| D512,979 | S | 12/2005 | Corcoran et al. |
| 6,975,402 | B2 | 12/2005 | Bisson et al. |
| 6,978,159 | B2 | 12/2005 | Feng et al. |
| 7,043,037 | B2 | 5/2006 | Lichtblau |
| 7,050,675 | B2 | 5/2006 | Zhou |
| 7,057,256 | B2 | 6/2006 | Carey, III et al. |
| 7,058,182 | B2 | 6/2006 | Kates |
| 7,072,475 | B1 | 7/2006 | DeNap et al. |
| 7,076,076 | B2 | 7/2006 | Bauman |
| 7,095,981 | B1 | 8/2006 | Voroba et al. |
| 7,167,572 | B1 | 1/2007 | Harrison et al. |
| 7,174,026 | B2 | 2/2007 | Niederdrank |
| 7,203,331 | B2 | 4/2007 | Boesen |
| 7,239,069 | B2 | 7/2007 | Cho |
| 7,245,732 | B2 | 7/2007 | Jorgensen et al. |
| 7,255,457 | B2 | 8/2007 | Ducharme et al. |
| 7,289,639 | B2 | 10/2007 | Abel et al. |
| 7,322,930 | B2 | 1/2008 | Jaeger et al. |
| 7,349,741 | B2 | 3/2008 | Maltan et al. |
| 7,354,792 | B2 | 4/2008 | Carey, III et al. |
| 7,376,563 | B2 | 5/2008 | Leysieffer et al. |
| 7,390,689 | B2 | 6/2008 | Mazur et al. |
| 7,394,909 | B1 | 7/2008 | Widmer et al. |
| 7,421,087 | B2 | 9/2008 | Perkins et al. |
| 7,424,122 | B2 | 9/2008 | Ryan |
| 7,444,877 | B2 | 11/2008 | Li et al. |
| 7,547,275 | B2 | 6/2009 | Cho |
| 7,668,325 | B2 | 2/2010 | Puria et al. |
| 8,715,154 | B2 | 5/2014 | Perkins et al. |
| 2001/0003788 | A1 | 6/2001 | Ball et al. |
| 2001/0027342 | A1 | 10/2001 | Dormer |
| 2001/0043708 | A1 | 11/2001 | Brimhall |
| 2001/0053871 | A1 | 12/2001 | Zilberman et al. |
| 2002/0012438 | A1 | 1/2002 | Leysieffer et al. |
| 2002/0029070 | A1 | 3/2002 | Leysieffer et al. |
| 2002/0030871 | A1 | 3/2002 | Anderson et al. |
| 2002/0035309 | A1 | 3/2002 | Leysieffer |
| 2002/0086715 | A1 | 7/2002 | Sahagen |
| 2002/0172350 | A1 | 11/2002 | Edwards et al. |
| 2002/0183587 | A1 | 12/2002 | Dormer |
| 2003/0064746 | A1 | 4/2003 | Rader et al. |
| 2003/0097178 | A1 | 5/2003 | Roberson et al. |
| 2003/0125602 | A1 | 7/2003 | Sokolich et al. |
| 2003/0142841 | A1 | 7/2003 | Wiegand |
| 2003/0208099 | A1 | 11/2003 | Ball |
| 2004/0165742 | A1 | 8/2004 | Shennib et al. |
| 2004/0184732 | A1 | 9/2004 | Zhou |
| 2004/0208333 | A1 | 10/2004 | Cheung et al. |
| 2004/0234089 | A1 | 11/2004 | Rembrand et al. |
| 2004/0234092 | A1 | 11/2004 | Wada et al. |
| 2004/0240691 | A1 | 12/2004 | Grafenberg |
| 2005/0020873 | A1 | 1/2005 | Berrang et al. |
| 2005/0036639 | A1 | 2/2005 | Bachler et al. |
| 2005/0163333 | A1 | 7/2005 | Abel et al. |
| 2005/0226446 | A1 | 10/2005 | Luo et al. |
| 2006/0023908 | A1 | 2/2006 | Perkins et al. |
| 2006/0058573 | A1 | 3/2006 | Neisz et al. |
| 2006/0062420 | A1 | 3/2006 | Araki |
| 2006/0107744 | A1 | 5/2006 | Li et al. |
| 2006/0161255 | A1 | 7/2006 | Zarowski et al. |
| 2006/0177079 | A1 | 8/2006 | Baekgaard Jensen et al. |
| 2006/0183965 | A1 | 8/2006 | Kasic, II et al. |
| 2006/0189841 | A1 | 8/2006 | Pluvinage |
| 2006/0231914 | A1 | 10/2006 | Carey, II et al. |
| 2006/0233398 | A1 | 10/2006 | Husung |
| 2007/0083078 | A1 | 4/2007 | Easter et al. |
| 2007/0100197 | A1 | 5/2007 | Perkins et al. |
| 2007/0127748 | A1 | 6/2007 | Carlile et al. |
| 2007/0135870 | A1 | 6/2007 | Shanks et al. |
| 2007/0161848 | A1 | 7/2007 | Dalton et al. |
| 2007/0191673 | A1 | 8/2007 | Ball et al. |
| 2007/0225776 | A1 | 9/2007 | Fritsch et al. |
| 2007/0236704 | A1 | 10/2007 | Carr |
| 2007/0250119 | A1 | 10/2007 | Tyler et al. |
| 2007/0251082 | A1 | 11/2007 | Milojevic et al. |
| 2007/0286429 | A1 | 12/2007 | Grafenberg et al. |
| 2008/0021518 | A1 | 1/2008 | Hochmair et al. |
| 2008/0051623 | A1 | 2/2008 | Schneider et al. |
| 2008/0107292 | A1 | 5/2008 | Kornagel |
| 2008/0188707 | A1 | 8/2008 | Bernard et al. |
| 2008/0298600 | A1 | 12/2008 | Poe et al. |
| 2009/0023976 | A1 | 1/2009 | Cho et al. |
| 2009/0043149 | A1 | 2/2009 | Abel et al. |
| 2009/0092271 | A1 | 4/2009 | Fay et al. |
| 2009/0097681 | A1 | 4/2009 | Puria et al. |
| 2009/0141919 | A1 | 6/2009 | Spitaels et al. |
| 2010/0034409 | A1 | 2/2010 | Fay et al. |
| 2010/0048982 | A1 | 2/2010 | Puria et al. |
| 2010/0312040 | A1 | 12/2010 | Puria et al. |
| 2010/0317914 | A1 | 12/2010 | Puria et al. |
| 2011/0152603 | A1 | 6/2011 | Perkins et al. |

FOREIGN PATENT DOCUMENTS

| | | | |
|---|---|---|---|
| DE | 3508830 | A1 | 9/1986 |
| EP | 0242038 | A3 | 5/1987 |
| EP | 0242038 | A2 | 10/1987 |
| EP | 0291325 | A2 | 11/1988 |
| EP | 0296092 | A2 | 12/1988 |
| EP | 0296092 | A3 | 8/1989 |
| EP | 0352954 | A2 | 1/1990 |
| EP | 0291325 | A3 | 6/1990 |
| EP | 0352954 | A3 | 8/1991 |
| EP | 1845919 | A1 | 10/2007 |
| FR | 2455820 | A1 | 11/1980 |
| JP | 60-154800 | A | 8/1985 |
| JP | 09-327098 | A | 12/1997 |
| KR | 10-0624445 | B1 | 9/2006 |
| WO | WO 92/09181 | A1 | 5/1992 |
| WO | WO 97/36457 | A1 | 10/1997 |
| WO | WO 97/45074 | A1 | 12/1997 |
| WO | WO 98/06236 | A1 | 2/1998 |
| WO | WO 99/03146 | A1 | 1/1999 |
| WO | WO 99/15111 | A1 | 4/1999 |
| WO | WO 01/50815 | A1 | 7/2001 |
| WO | WO 01/58206 | A2 | 8/2001 |

(56) References Cited

FOREIGN PATENT DOCUMENTS

| | | | |
|---|---|---|---|
| WO | WO 01/58206 | A3 | 2/2002 |
| WO | WO 02/39874 | A2 | 5/2002 |
| WO | WO 02/39874 | A3 | 2/2003 |
| WO | WO 03/063542 | A2 | 7/2003 |
| WO | WO 03/063542 | A3 | 1/2004 |
| WO | WO 2004/010733 | A1 | 1/2004 |
| WO | WO 2005/015952 | A1 | 2/2005 |
| WO | WO 2006/042298 | A2 | 4/2006 |
| WO | WO 2006/075169 | A1 | 7/2006 |
| WO | WO 2006/075175 | A1 | 7/2006 |
| WO | WO 2006/042298 | A3 | 10/2006 |
| WO | WO 2009/047370 | A2 | 4/2009 |
| WO | WO 2009/056167 | A1 | 5/2009 |
| WO | WO 2009/047370 | A3 | 7/2009 |

OTHER PUBLICATIONS

U.S. Appl. No. 60/702,532, filed Jul. 25, 2005, Aljuri.
U.S. Appl. No. 61/099,087, filed Sep. 22, 2008, Rucker.
Atasoy [Paper] Opto-acoustic Imaging. for BYM504E Biomedical Imaging Systems class at ITU, downloaded from the Internet www2.itu.edu.td—cilesiz/courses/BYM504- 2005-OA 504041413.pdf, 14 pages.
Athanassiou, et al. Laser controlled photomechanical actuation of photochromic polymers Microsystems. Rev. Adv. Mater. Sci. 2003; 5:245-251.
Ayatollahi, et al. Design and Modeling of Micromachined Condenser MEMS Loudspeaker using Permanent Magnet Neodymium-Iron-Boron (Nd-Fe-B). IEEE International Conference on Semiconductor Electronics, 2006. ICSE '06, Oct. 29, 2006-Dec. 1, 2006; 160-166.
Baer, et al. Effects of Low Pass Filtering on the Intelligibility of Speech in Noise for People With and Without Dead Regions at High Frequencies. J. Acost. Soc. Am 112 (3), pt. 1, (Sep. 2002), pp. 1133-1144.
Best, et al. The influence of high frequencies on speech localization. Abstract 981 (Feb. 24, 2003) from www.aro.org/abstracts/abstracts.html.
Birch, et al. Microengineered systems for the hearing impaired. IEE Colloquium on Medical Applications of Microengineering, Jan. 31, 1996; pp. 2/1-2/5.
Burkhard, et al. Anthropometric Manikin for Acoustic Research. J. Acoust. Soc. Am., vol. 58, No. 1, (Jul. 1975), pp. 214-222.
Camacho-Lopez, et al. Fast Liquid Crystal Elastomer Swims Into the Dark, Electronic Liquid Crystal Communications. Nov. 26, 2003; 9 pages total.
Carlile, et al. Spatialisation of talkers and the segregation of concurrent speech. Abstract 1264 (Feb. 24, 2004) from www.aro.org/abstracts/abstracts.html.
Cheng, et al. A Silicon Microspeaker for Hearing Instruments. Journal of Micromechanics and Microengineering 2004; 14(7):859-866.
Datskos, et al. Photoinduced and thermal stress in silicon microcantilevers. Applied Physics Letters. Oct. 19, 1998; 73(16):2319-2321.
Decraemer, et al. A method for determining three-dimensional vibration in the ear. Hearing Res., 77:19-37 (1994).
Ear. Retrieved from the Internet: wwwmgs.bionet.nsc.ru/mgs/gnw/trrd/thesaurus/Se/ear.htm. 4 pages total, downloaded Jun. 17, 2008.
Fay, et al. Cat eardrum response mechanics. Calladine Festschrift (2002), Ed. S. Pellegrino, The Netherlands, Kluwer Academic Publishers.
Fay. Cat eardrum mechanics. Ph.D. thesis. Disseration submitted to Department of Aeronautics and Astronautics. Standford University. May 2001; 210 pages total.
Fletcher. Effects of Distortion on the Individual Speech Sounds. Chapter 18, ASA Edition of Speech and Hearing in Communication, Acoust Soc.of Am. (republished in 1995) pp. 415-423.
Freyman, et al. Spatial Release from Informational Masking in Speech Recognition. J. Acost. Soc. Am., vol. 109, No. 5, pt. 1, (May 2001); 2112-2122.
Freyman, et al. The Role of Perceived Spatial Separation in the Unmasking of Speech. J. Acoust. Soc. Am., vol. 106, No. 6, (Dec. 1999); 3578-3588.
Gennum, GA3280 Preliminary Data Sheet: Voyageur TD Open Platform DSP System for Ultra Low Audio Processing, downloaded from the Internet: www.sounddesigntechnologies.com/products/pdf/37601DOC.pdf, Oct. 2006; 17 pages.
Gobin, et al. Comments on the physical basis of the active materials concept. Proc. SPIE 2003; 4512:84-92.
Hato, et al. Three-dimensional stapes footplate motion in human temporal bones. Audiol. Neurootol., 8:140-152 (Jan. 30, 2003).
Headphones. Wikipedia Entry, downloaded from the Internet : en.wikipedia.org/wiki/Headphones. 9 pages total, Oct. 27, 2008.
Hofman, et al. Relearning Sound Localization With New Ears. Nature Neuroscience, vol. 1, No. 5, (Sep. 1998); 417-421.
International search report and written opinion dated Feb. 8, 2011 for PCT/US2011/039792.
Izzo, et al. Laser Stimulation of Auditory Neurons: Effect of Shorter Pulse Duration and Penetration Depth. Biophys J. Apr. 15, 2008;94(8):3159-3166.
Izzo, et al. Laser Stimulation of the Auditory Nerve. Lasers Surg Med. Sep. 2006;38(8):745-753.
Izzo, et al. Selectivity of Neural Stimulation in the Auditory System: A Comparison of Optic and Electric Stimuli. J Biomed Opt. Mar.-Apr. 2007;12(2):021008.
Jin, et al. Speech Localization. J. Audio Eng. Soc. convention paper, presented at the AES 112th Convention, Munich, Germany, May 10-13, 2002, 13 pages total.
Killion. Myths About Hearing Noise and Directional Microphones. The Hearing Review. Feb. 2004; 11(2):14, 16, 18, 19, 72 & 73.
Killion. SNR loss: I can hear what people say but I can't understand them. The Hearing Review, 1997; 4(12):8-14.
Lee, et al. A Novel Opto-Electromagnetic Actuator Coupled to the tympanic Membrane. Journal of Biomechanics. 41(16): 3515-3518, 2008.
Lee, et al. The optimal magnetic force for a novel actuator coupled to the tympanic membrane: a finite element analysis. Biomedical engineering: applications, basis and communications. 2007; 19(3):171-177.
Lezal. Chalcogenide glasses—survey and progress. J. Optoelectron Adv Mater., Mar. 2003; 5 (1):23-34.
Markoff. Intuition + Money: An Aha Moment. New York Times Oct. 11, 2008, p. BU4, 3 pages total.
Martin, et al. Utility of Monaural Spectral Cues is Enhanced in the Presence of Cues to Sound-Source Lateral Angle. JARO. 2004; 5:80-89.
Moore. Loudness perception and intensity resolution. Cochlear Hearing Loss, Chapter 4, pp. 90-115, Whurr Publishers Ltd., London (1998).
Murugasu, et al. Malleus-to-footplate versus malleus-to-stapes-head ossicular reconstruction prostheses: temporal bone pressure gain measurements and clinical audiological data. Otol Neurotol. Jul. 2005; 2694):572-582.
Musicant, et al. Direction-Dependent Spectral Properties of Cat External Ear: New Data and Cross-Species Comparisons. J. Acostic. Soc. Am, May 10-13, 2002, vol. 87, No. 2, (Feb. 1990), pp. 757-781.
National Semiconductor, LM4673 Boomer: Filterless, 2.65W, Mono, Class D Audio Power Amplifier, [Data Sheet] downloaded from the Internet: <<http://www.national.com/ds/LM/LM4673.pdf>>; Nov. 1, 2007; 24 pages.
O'Connor, et al. Middle ear Cavity and Ear Canal Pressure-Driven Stapes Velocity Responses in Human Cadaveric Temporal Bones. J Acoust Soc Am. Sep. 2006;120(3):1517-28.
Office action dated Jun. 21, 2013 for U.S. Appl. No. 12/822,801.
Office action dated Dec. 10, 2012 for U.S. Appl. No. 12/822,801.
Perkins, et al. The EarLens System: New sound transduction methods. Hear Res. Feb. 2, 2010; 10 pages total.
Poosanaas, et al. Influence of sample thickness on the performance of photostrictive ceramics, J. App. Phys. Aug. 1, 1998; 84(3):1508-1512.
Puria et al. A gear in the middle ear. ARO Denver CO, 2007b.

(56) References Cited

OTHER PUBLICATIONS

Puria, et al. Malleus-to-footplate ossicular reconstruction prosthesis positioning: cochleovestibular pressure optimization. Otol Nerotol. May 2005; 2693):368-379.
Puria, et al. Measurements and model of the cat middle ear: Evidence of tympanic membrane acoustic delay. J. Acoust. Soc. Am., 104(6):3463-3481 (Dec. 1998).
Puria, et al. Middle Ear Morphometry From Cadaveric Temporal Bone MicroCT Imaging. Proceedings of the 4th International Symposium, Zurich, Switzerland, Jul. 27-30, 2006, Middle Ear Mechanics in Research and Otology, pp. 259-268.
Puria, et al. Sound-Pressure Measurements in the Cochlear Vestibule of Human-Cadaver Ears. Journal of the Acoustical Society of America. 1997; 101 (5-1): 2754-2770.
Roush. SiOnyx Brings "Black Silicon" into the Light; Material Could Upend Solar, Imaging Industries. Xconomy, Oct. 12, 2008, retrieved from the Internet: www.xconomy.com/boston/2008/10/12/sionyx-brings-black- silicon-into-the-light—material-could-upend-solar-imaging-industries> 4 pages total.
Rubinstein. How Cochlear Implants Encode Speech, Curr Opin Otolaryngol Head Neck Surg. Oct. 2004;12(5):444-8; retrieved from the Internet: www.ohsu.edu/nod/documents/week3/Rubenstein.pdf.
Sekaric, et al. Nanomechanical resonant structures as tunable passive modulators. App. Phys. Left. Nov. 2003; 80(19):3617-3619.
Shaw. Transformation of Sound Pressure Level From the Free Field to the Eardrum in the Horizontal Plane. J. Acoust. Soc. Am., vol. 56, No. 6, (Dec. 1974), 1848-1861.
Shih. Shape and displacement control of beams with various boundary conditions via photostrictive optical actuators. Proc. IMECE. Nov. 2003; 1-10.
Sound Design Technologies,—Voyager TDTM Open Platform DSP System for Ultra Low Power Audio Processing—GA3280 Data Sheet. Oct. 2007; retrieved from the Internet: www.sounddes.com/pdf/37601DOC.pdf, 15 page total.
Stenfelt, et al. Bone-Conducted Sound: Physiological and Clinical Aspects. Otology & Neurotology, Nov. 2005; 26 (6):1245-1261.
Stuchlik, et al. Micro-Nano Actuators Driven by Polarized Light. IEEE Proc. Sci. Meas. Techn. Mar. 2004; 151(2):131-136.
Stuchlik, et al. Micro-Nano actuators driven by polarized light. lEE Proc. Sci. Meas. Techn. Mar. 2004; 151(2):131-136.
Suski, et al. Optically activated ZnO/Si02/Si cantilever beams. Sensors and Actuators A (Physical), 0 (nr: 24). 2003; 221-225.
Takagi, et al. Mechanochemical Synthesis of Piezoelectric PLZT Powder. KONA. 2003; 51(21):234-241.
Thakoor, et al. Optical microactuation in piezoceramics. Proc. SPIE. Jul. 1998; 3328:376-391.
Tzou, et al. Smart Materials, Precision Sensors/Actuators, Smart Structures, and Structronic Systems. Mechanics of Advanced Materials and Structures. 2004; 11:367-393.
Uchino, et al. Photostricitve actuators. Ferroelectrics. 2001; 258:147-158.
Vickers, et al. Effects of Low-Pass Filtering on the Intelligibility of Speech in Quiet for People With and Without Dead Regions at High Frequencies. J. Acoust. Soc. Am. Aug. 2001; 110(2):1164-1175.
Vinikman-Pinhasi, et al. Piezoelectric and Piezooptic Effects in Porous Silicon. Applied Physics Letters, Mar. 2006; 88(11): 11905-111906.
Wang, et al. Preliminary assessment of remote photoelectric excitation of an actuator for a hearing omplant. Proceeding of the 2005 IEEE, Engineering in Medicine and Biology 27th annual conference, Shanghai, China. Sep. 1-4, 2005; 6233-6234.
Wiener, et al. On the Sound Pressure Transformation by the Head and Auditory Meatus of the Cat. Acta Otolaryngol. Mar. 2006; 61(3):255-269.
Wightman, et al. Monaural Sound Localization Revisited. J. Acoust. Soc. Am. Feb. 1997; 101(2):1050-1063.
Yu et al. Piezoelectric Microspeaker with Compressive Nitride Diaphragm. The Fifteenth IEEE International Conference on Micro Electro Mechanical Systems, 2002; 260-263.
Yu, et al. Photomechanics: Directed bending of a polymer film by light. Nature. Sep. 2003; 425:145.

* cited by examiner

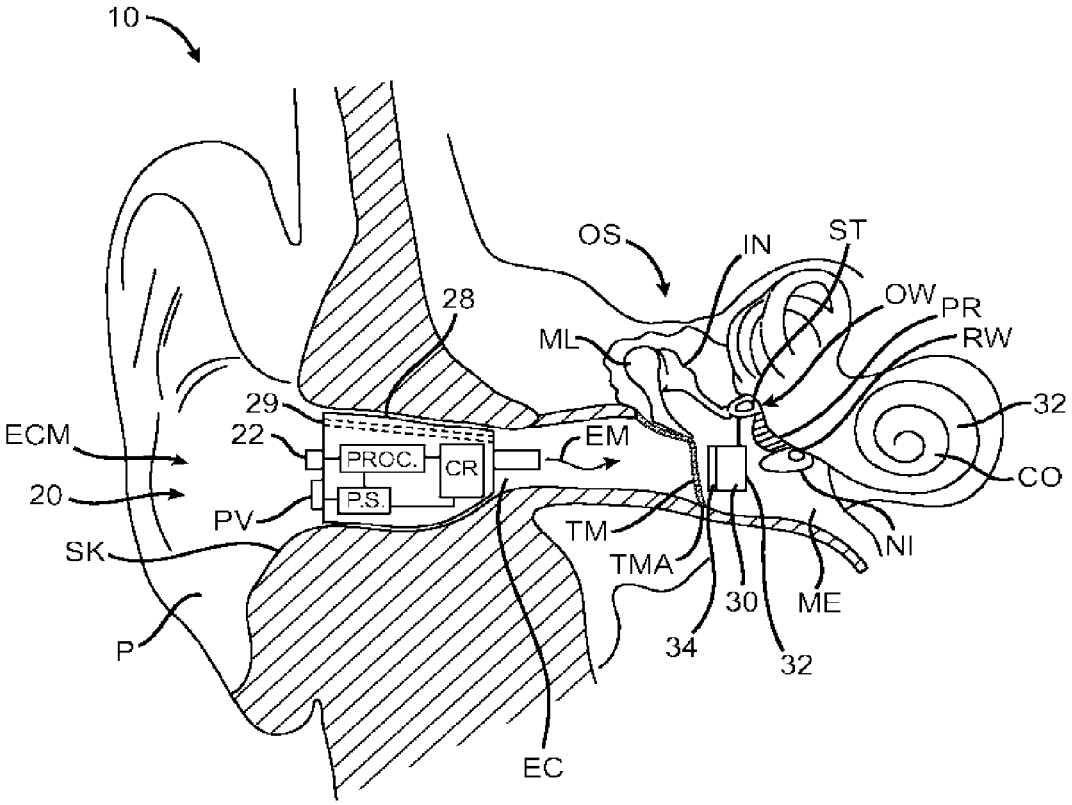
FIG. 1A1

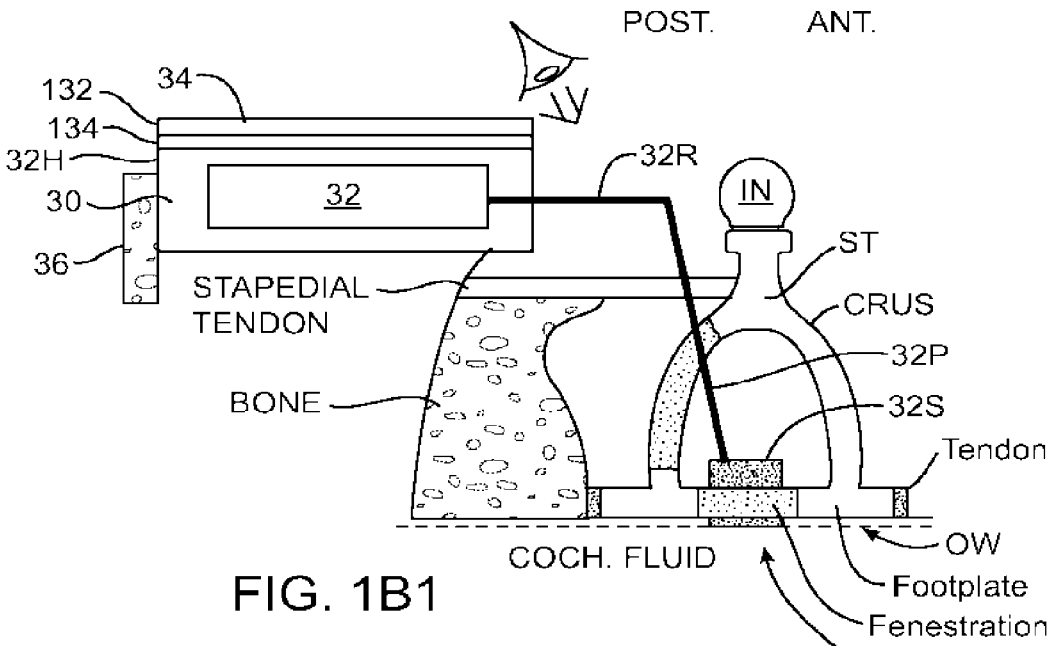
FIG. 1B1
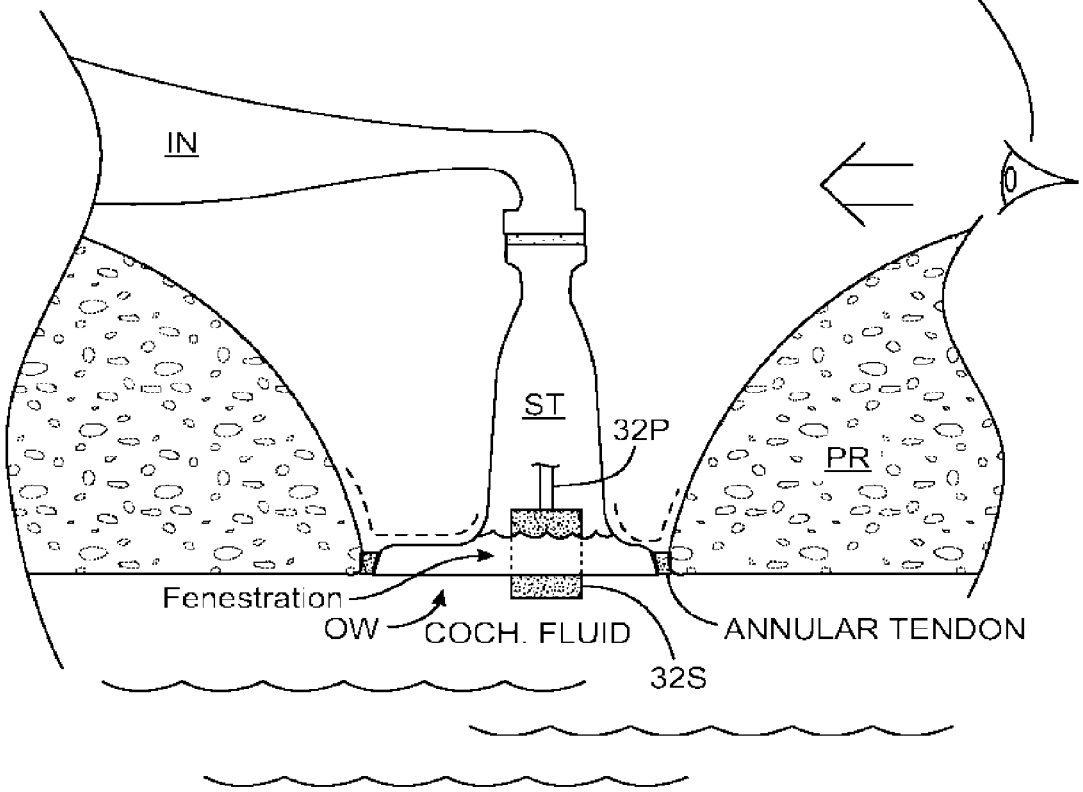
FIG. 1B2

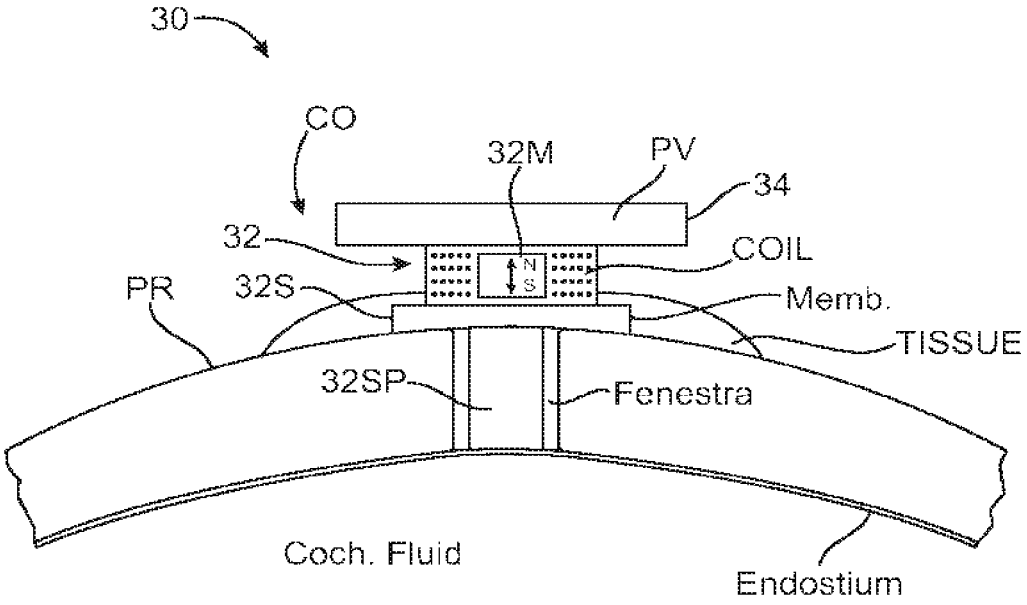
FIG. 2A1

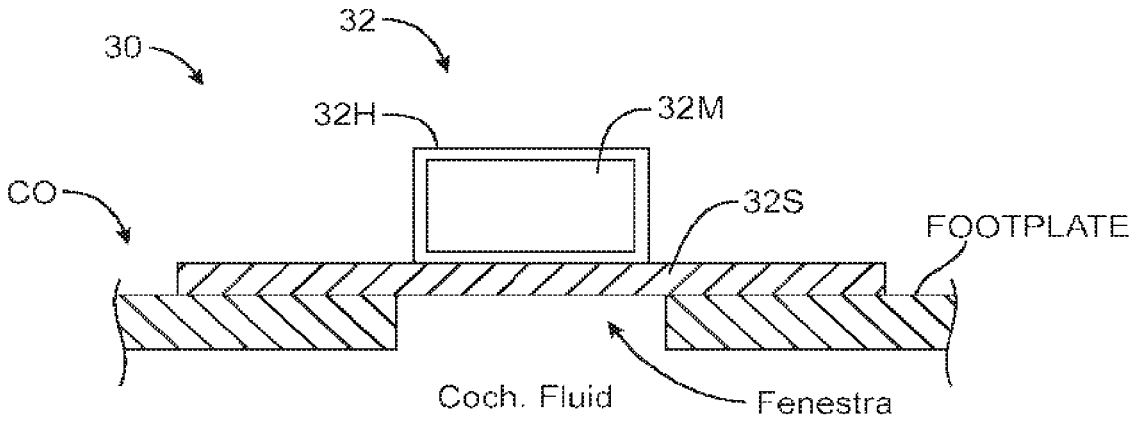
FIG. 2B
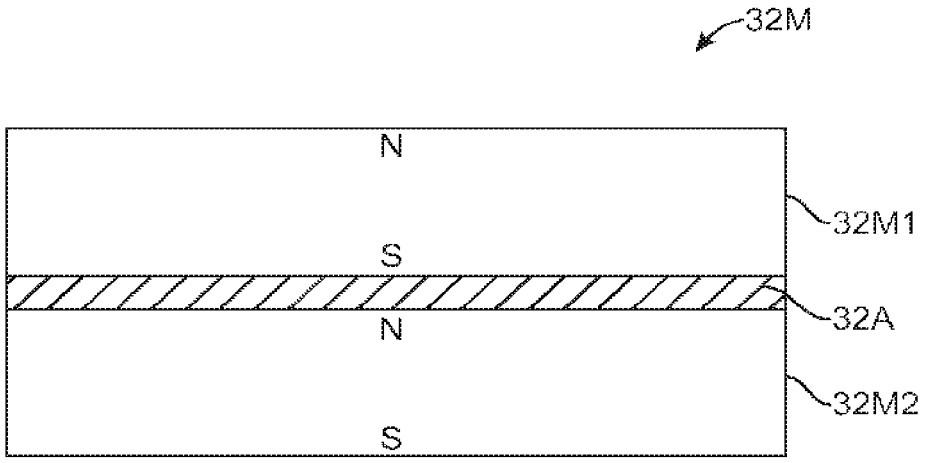
FIG. 2B1

OPTICALLY COUPLED COCHLEAR ACTUATOR SYSTEMS AND METHODS

CROSS-REFERENCES TO RELATED APPLICATIONS

The present patent application is a continuation of and claims priority to U.S. patent application Ser. No. 12/822,801 filed 24 Jun. 2010, entitled "Optically Coupled Cochlear Actuator Systems and Methods", which is a non-provisional of and claims priority to U.S. Pat. App. Ser. No. 61/219,861 filed 24 Jun. 2009, entitled "Optically Coupled Cochlear Actuator Systems and Methods", the full disclosures of which are incorporated herein by reference.

STATEMENT AS TO RIGHTS TO INVENTIONS MADE UNDER FEDERALLY SPONSORED RESEARCH AND DEVELOPMENT

NOT APPLICABLE

BACKGROUND OF THE INVENTION

1. Field of the Invention

The present invention is related to hearing systems, devices and methods. Although specific reference is made to hearing aid systems, embodiments of the present invention can be used in many applications in which a signal is used to stimulate the ear.

People like to hear. Hearing allows people to listen to and understand others. Natural hearing can include spatial cues that allow a user to hear a speaker, even when background noise is present. People also like to communicate with those who are far away, such as with cellular phones.

Hearing devices can be used with communication systems to help the hearing impaired and to help people communicate with others who are far away. At least some hearing impaired people have a mixed hearing loss. With mixed hearing loss, a person may have a conductive hearing loss that occurs in combination with a sensorineural hearing loss. The conductive hearing loss may be due to diminished function of the conductive components of the ear such as the eardrum and ossicles that transmit sound from the ear canal to the cochlea. The sensorineural hearing loss may comprise diminished function of the cochlea, such that the cochlea does not convert sound waves to neural impulses as effectively as would be ideal.

Many of the prior therapies for mixed hearing loss and sensorineural hearing loss are less than ideal in at least some instances. One approach has been to replace, at least partially, one or more of the ossicles of the middle ear with an ossicular replacement prosthesis. Although the ossicular replacement prosthesis can improve the conductive portion of the mixed hearing loss, such treatment may leave the patient with diminished hearing due to the remaining sensorineural hearing loss in at least some instances. Another approach has been to use bone conduction of sound with a bone-anchored hearing aid (hereinafter "BAHA™"). However, bone conduction based hearing devices may not offer sound localization to the user in at least some instances, such that at least some people may not be able localize the source of sound in at least some instances. This lack of sound localization may make hearing difficult for the user in at least some instances. Also, such bone anchoring can be somewhat invasive and may require the user to clean the device in at least some instances.

Prior acoustic hearing devices such as conventional in the ear or behind the ear hearing aids can cause feedback at high frequencies such that sound localization cues may not be present with such devices in at least some instances. Although a magnet coupled to the eardrum can result in decreased feedback, such devices can be susceptible to user perceivable noise, for example humming, in the presence of electromagnetic fields in at least some instances. Although optically coupled hearing devices have been proposed, optical coupling can result in user perceptible distortion of the signal in at least some instances that may be related to non-linearities of the optical coupling.

For the above reasons, it would be desirable to provide hearing systems which at least decrease, or even avoid, at least some of the above mentioned limitations of the current prosthetic devices. For example, there is a need to provide a hearing prosthesis which provides hearing with natural qualities, for example with spatial information cues, and which allow the user to hear with less occlusion, distortion and feedback than current devices.

2. Description of the Background Art

Patents and publications that may be relevant to the present application include: U.S. Pat. Nos. 3,585,416; 3,764,748; 3,882,285; 4,498,461; 5,142,186; 5,360,388; 5,554,096; 5,624,376; 5,795,287; 5,800,336; 5,825,122; 5,857,958; 5,859,916; 5,888,187; 5,897,486; 5,913,815; 5,949,895; 6,005,955; 6,068,590; 6,093,144; 6,139,488; 6,174,278; 6,190,305; 6,208,445; 6,217,508; 6,222,302; 6,241,767; 6,422,991; 6,475,134; 6,519,376; 6,554,761; 6,620,110; 6,626,822; 6,676,592; 6,629,922; 6,728,024; 6,735,318; 6,900,926; 6,920,340; 7,072,475; 7,095,981; 7,239,069; 7,289,639; D512,979; 2002/0086715; 2003/0142841; 2004/0234092; 2005/0020873; 2006/0107744; 2006/0233398; 2006/075175; 2007/0083078; 2007/0191673; 2008/0021518; 2008/0107292; commonly owned U.S. Pat. Nos. 5,259,032; 5,276,910; 5,425,104; 5,804,109; 6,084,975; 6,554,761; 6,629,922; U.S. Publication Nos. 2006/0023908; 2006/0189841; 2006/0251278; and 2007/0100197. Non-U.S. patents and publications that may be relevant include EP1845919 PCT Publication Nos. WO 03/063542; WO 2006/075175; U.S. Publication Nos. Journal publications that may be relevant include: Ayatollahi et al., "Design and Modeling of Micromachines Condenser MEMS Loudspeaker using Permanent Magnet Neodymium-Iron-Boron (Nd—Fe—B)", ISCE, Kuala Lampur, 2006; Birch et al, "Microengineered Systems for the Hearing Impaired", IEE, London, 1996; Cheng et al., "A silicon microspeaker for hearing instruments", J. Micromech. Microeng., 14 (2004) 859-866; Yi et al., "Piezoelectric microspeaker with compressive nitride diaphragm", IEEE, 2006, and Zhigang Wang et al., "Preliminary Assessment of Remote Photoelectric Excitation of an Actuator for a Hearing Implant", IEEE Engineering in Medicine and Biology 27th Annual Conference, Shanghai, China, Sep. 1-4, 2005. Other publications of interest include: Gennum GA3280 Preliminary Data Sheet, "Voyager TDTM. Open Platform DSP System for Ultra Low Power Audio Processing" and National Semiconductor LM4673 Data Sheet, "LM4673 Filterless, 2.65 W, Mono, Class D audio Power Amplifier"; Puria, S. et al., Middle ear morphometry from cadaveric temporal bone micro CT imaging, Invited Talk. MEMRO 2006, Zurich; Puria, S. et al, A gear in the middle ear ARO 2007, Baltimore, Md.; and Lee et al., "The Optimal Magnetic Force For A Novel Actuator Coupled to the Tympanic Membrane: A Finite Element Analysis," Biomedical Engineering: Applications, Basis and Communications, Vol. 19, No. 3(171-177), 2007.

For the above reasons, it would be desirable to provide hearing systems which at least decrease, or even avoid, at least some of the above mentioned limitations of the prior hearing devices. For example, there is a need to provide a comfortable hearing device which provides hearing with natural qualities, for example with spatial information cues to people with mixed hearing loss, and which allows the user to hear with less occlusion, distortion and feedback than prior devices.

BRIEF SUMMARY OF THE INVENTION

Embodiments of the present invention provide improved systems devices and methods that overcome at least some of the limitations of the prior hearing devices. Embodiments of the present invention can improve the hearing of people with conductive hearing loss, sensorineural hearing loss and mixed hearing loss. The embodiments described herein can be particularly well suited for use with patients having mixed hearing loss, for example where the conductive component loss is due to otosclerosis. At least some embodiments comprise coupling of healthy ears to communication devices, for example for cell phone calls and entertainment.

In many embodiments, a transducer is configured to couple to the cochlear fluid so as to transmit sound with less energy than prior devices so as to improve hearing. The transducer can vibrate the fluid of the cochlea with substantially less energy, such that feed back to a microphone positioned in the ear canal is inhibited substantially. The cochlear fluid coupled hearing device can allow a user to determine from which side a sound originates with vibration of the cochlea and the user can also receive sound localization cues from the device, as feedback can be substantially inhibited. The transducer may be coupled to the cochlear fluid with a thin membrane disposed between the transducer and the cochlear fluid, for example with a fenestration in the cochlea. In some embodiments, a support coupled to the transducer directly contacts the fluid of the cochlea so as to improve coupling. Alternatively or in combination, the transducer may couple to a foot plate of the stapes. For example, the transducer may couple to a support that extends through a fenestration in the footplate of the stapes. An output transducer assembly can be positioned on a first side of the user to vibrate a first cochlear fluid near a first cochlea with a first amount of energy, such vibration of a second cochlea on a second side with a second amount of energy is attenuated substantially, for example at least about 6 db, such that the user can localize the sound to the first side. For example, a microphone may be located on the first side and coupled to the output transducer assembly to vibrate the first cochlea with the first energy and the second cochlea with the second energy, such that the user localizes the sound to the first side. The microphone may be placed in an ear canal of the first side, or outside the ear canal and within about 5 mm of the ear canal opening, such that the microphone can detect sound localization cues diffracted from the pinna, for example, and comprising frequencies of at least about 4 kHz, for example from about 4 kHz to 15 kHz. The first output transducer assembly can vibrate the first cochlea such that the user can determine a location of the sound on the first side with the sound localization cues. In many embodiments, a hearing system comprises a first output assembly on the first side and the second output assembly on the second side.

In a first aspect, embodiments of the present invention provide a device to transmit a sound to a user having a middle ear and a cochlea comprising a cochlear fluid. An input assembly is configured to receive a sound input. An output assembly comprises a transducer configured to couple to the cochlear fluid to transmit the sound to the user.

In many embodiments, the output assembly is configured to couple to the cochlear fluid with a support configured to contact the cochlear fluid. The support can be configured to contact the cochlear fluid with a fenestration formed in at least one of cochlear bone tissue or a footplate of the stapes. The support may comprise a rigid material, for example, sized to fit within the fenestration formed in the stapes, and the rigid material may comprise a biocompatible material configured to integrate with bone tissue of the stapes. The support may comprise a length and a width, and the width can be sized to fit a diameter of the fenestration. The length can be sized to extend at least across a thickness of the foot plate of the stapes from the middle ear to an oval window of the cochlea.

In many embodiments, the support comprises a thin flexible membrane configured to extend across the fenestration to seal the cochlea and vibrate the cochlear fluid.

In many embodiments, the transducer comprises at least one of a coil, a magnet, the coil and the magnet, a piezoelectric transducer, a photostrictive transducer, a magnetostrictive transducer or a balanced armature transducer. For example, the transducer may comprise the balanced armature transducer, and the balanced armature transducer can be configured for placement on a promontory of the user. The balanced armature transducer is configured to couple to a footplate of the stapes with a structure extending substantially from the balance armature transducer to the footplate of the stapes.

In many embodiments, the transducer comprises the magnet and the coil, and the magnet is configured to couple to a flexible support in contact with the cochlear fluid to vibrate the cochlea fluid.

In many embodiments, the input assembly is configured to transmit an electromagnetic signal to the output transducer assembly to vibrate the cochlear fluid in response to the sound input. The electromagnetic signal may comprise a magnetic field from a coil, and the output transducer assembly may comprise a magnet configured to vibrate the cochlear fluid in response to the magnetic field from the coil. The coil can be configured for placement in an ear canal of the user.

In many embodiments, the electromagnetic signal comprises light energy and the input assembly comprises at least one light source configured to emit the light energy. The output assembly may comprise at least one photodetector to receive the light energy, in which the photodetector is coupled to the transducer to vibrate the cochlear fluid in response to the light energy. The at least one photodetector may comprise at least one of photovoltaic material. The at least one photovoltaic material may comprise crystalline silicon, amorphous silicon, micromorphous silicon, black silicon, cadmium telluride, copper indium gallium selenide or indium gallium arsenide.

In many embodiments, the at least one photodetector comprises at least two photo detectors. The at least two photodetectors can be coupled to the transducer with an opposite polarity.

In another aspect, embodiments provide a method of transmitting a sound to a user having a middle ear and a cochlea comprising a cochlear fluid. A sound input is received with an input assembly. The cochlear fluid is vibrated with a transducer coupled to the cochlear fluid in response to the sound input to transmit the sound to the user.

In many embodiments, a support coupled to the cochlear fluid contacts the cochlear fluid and the support vibrates in response to the sound input to transmit the sound to the user.

The method of transmitting sound to the user may comprise using one or more of the components of an assembly as described herein in accordance with the function of the component as described herein so as to transmit the sound to the user.

In another aspect, embodiments provide a device for implantation in a middle ear of a user, the middle ear having a stapes. The device comprises a housing, a transducer and an expandable structure. The transducer is configured to vibrate the stapes, and the transducer is contained at least partially within the housing. The expandable structure is disposed on a portion of the housing, and the expandable structure and the housing are sized for placement at least partially between crura of the stapes to couple the transducer to the stapes.

In many embodiments, at least a portion of the housing is sized to contact a footplate of the stapes when the expandable structure and the housing are positioned at least partially between the crura. The expandable structure can be configured to contact the stapes between the crura.

In many embodiments, expandable structure comprises at least one of an expandable material, a spring, a sponge, a water absorbent material or a hydrogel.

In many embodiments, at least one photodetector is coupled to the transducer to vibrate the stapes. The at least one photodetector can be electrically coupled to the transducer with an electrical conductor sized to position the at least one photodetector on the promontory when the expandable material and the housing are positioned at least partially between the crura.

In many embodiments, the transducer comprises at least one of a coil, a magnet, the coil and the magnet, a piezoelectric transducer, a photostrictive transducer or a balanced armature transducer. For example, the transducer may comprise the coil and the magnet, and the coil and the magnet can be sized for placement at least partially between the crura.

In many embodiments, the transducer comprises the magnet and the magnet is sized for placement at least partially between the crura, and the coil is sized for placement in an ear canal of the user.

In another aspect, embodiments provide a method of implanting a device in a middle ear of a user, in which the middle ear has a stapes. An assembly is provided comprising an expandable structure, a housing and a transducer contained at least partially within the housing. The assembly is placed at least partially within crura of the stapes such that the expandable structure contacts the stapes to couple the transducer to the stapes.

The method comprises implanting one or more of the components of an assembly as described herein in accordance with the function of the component as described herein so as to transmit the sound to the user.

In another aspect, embodiments provide a device to transmit a sound to a user having a middle ear and a cochlea comprising a cochlear fluid. The device comprises an input assembly means for receiving a sound input, and an output assembly means for coupling to the input assembly means and for transmitting the sound to the user. The means for receiving the sound input may comprise one or more of the components of the input assembly as described herein. The means for coupling to the input assembly means and for transmitting the sound to the user may comprise one or more components of the output assembly so as to couple to the input assembly and transmit the sound to the user.

BRIEF DESCRIPTION OF THE DRAWINGS

FIG. 1A1 shows a hearing system comprising an ear canal module and a transducer coupled to a round window of a user with a support, in accordance with embodiments of the present invention;

FIGS. 1B1 and 1B2 show a schematic illustration of the transducer of the output transducer assembly coupled to the cochlear fluid with a support, in accordance with embodiments of the present invention;

FIG. 2A1 shows a schematic illustration of a transducer assembly as in FIG. 2A in which the support comprises a structure extending from an upper surface of the cochlear bone into the fenestra to couple to the endostium, in accordance with embodiments of the present invention;

FIG. 2B shows a schematic illustration of a transducer assembly comprising a magnet with a biocompatible housing positioned on a support in contact with cochlear fluid to couple the magnet to the cochlea;

FIG. 2B1 shows a magnet comprising a pair of opposing magnets suitable for use with many transducers as described herein, in accordance with embodiments;

DETAILED DESCRIPTION OF THE INVENTION

As used herein light encompasses infrared light, visible light and ultraviolet light.

Embodiments of the present invention can be used with many users to transmit many sounds. Examples of people who can benefit from the hearing devices described herein include people with conductive hearing loss, sensorineural hearing loss and mixed hearing loss. For example, people with mixed hearing loss can benefit from improved hearing with stereo sound based on bone conduction and sound localization cues based bone conduction. People with sensorineural hearing loss can receive sound localization cues, for example with frequencies above 4 kHz. The devices described herein can be integrated with communications devices, for example for cell phone calls and entertainment, with people who have healthy hearing.

Figure 1:
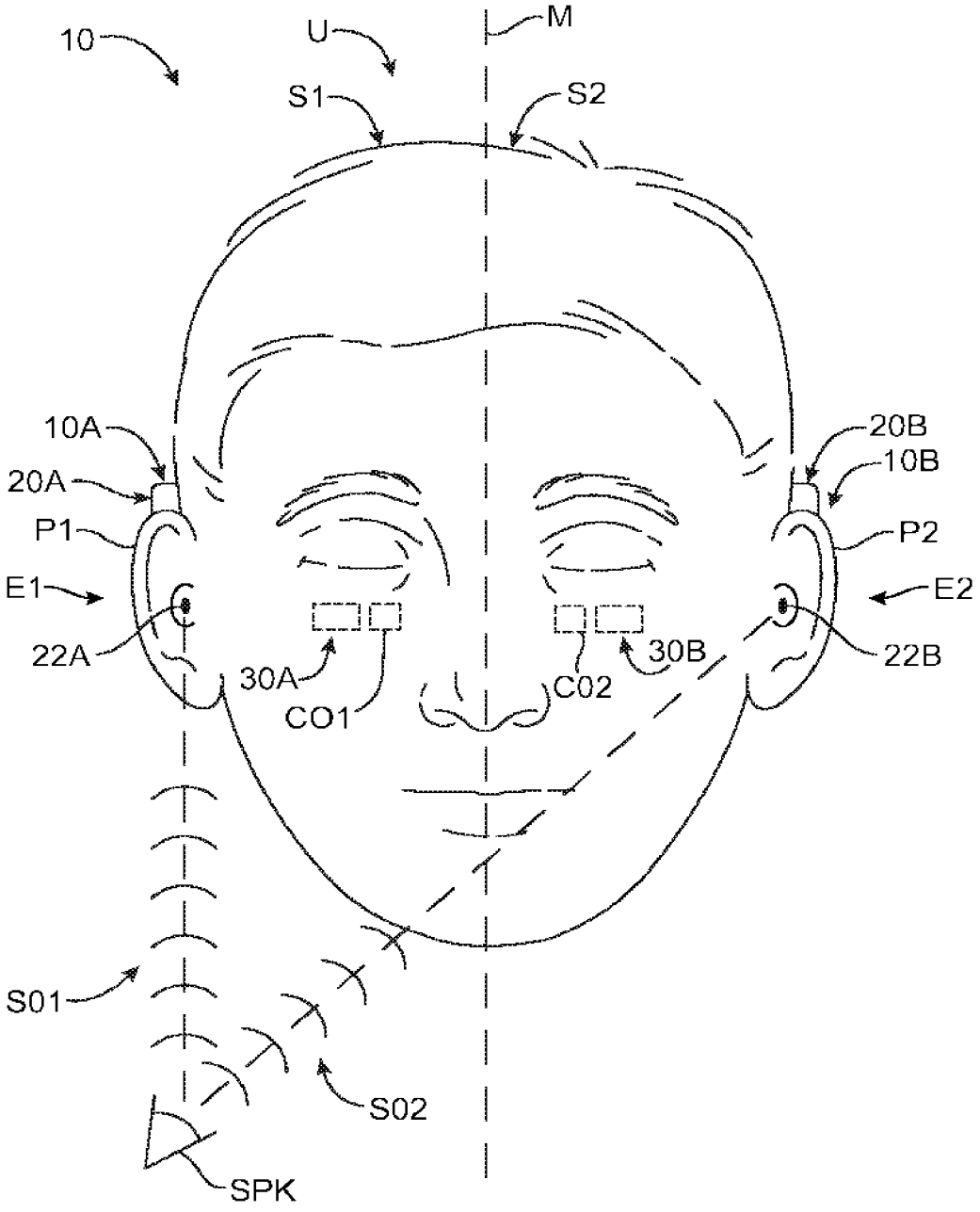
FIG. 1 shows a cochlear fluid vibration hearing system configured to provide sound localization cues to the user.

FIG. 1 shows a cochlea actuated hearing system 10 configured to provide sound to a user U with fluidic coupling to the cochlea. The system 10 is configured to provide stereo sound based on cochlear fluid coupling and localization cues based on cochlear fluid vibration. The user has a midline M, a first side Si with a first ear E1, and a second side Si with a second ear E1. Ear E1 has a first pinna P1 and ear E2 has a second pinna E2. The first side is disposed opposite the second side.

In many embodiments, hearing system 10 comprises a binaural hearing system a first hearing system 10A on first side S1 and a second hearing system 10B on a second side S2. However in some embodiments, the user may use only one hearing system, for example a user with one healthy hearing side and an opposite side having compromised hearing such as sensorineural hearing loss. First system 10A comprises a first input assembly 20A, and a first microphone 22A. The first input assembly may comprise a first behind the ear unit (hereinafter "BTE"), for example. First microphone 22A is shown positioned near a first ear canal opening of first ear E1. Second system 10B comprises a second input assembly 20B, and a second microphone 22B. The second input assembly may comprise second circuitry such as a BTE unit. The second microphone 22B is shown positioned near a second ear canal opening for second ear E2.

A first output transducer assembly 30A and a second output transducer assembly 30B are positioned on the first side S1 and second side S2, respectively, such that the user can localize sound to the first side S1 or the second side S2. First output transducer assembly 30A is positioned on side S1 near a first cochlea of the first side, and coupled to the first input transducer assembly. For example, the first output transducer assembly may be coupled to first mastoid bone or first cochlear bone of the first side of the user so as to vibrate the first cochlea CO1 on the first side with a first amount of energy. Second output transducer assembly 30B is positioned on side S2 near a second cochlea of the second side, and coupled to the first second input transducer assembly. For example, the second output transducer assembly may be coupled to mastoid bone or cochlear bone of the user on the second side so as to vibrate the second cochlea CO2 on the second side with a third amount of energy. The acoustic vibration from the second output assembly can cross the midline M and vibrate the second cochlea CO2 with a fourth amount of energy. The tissue of the user disposed between the second output transducer assembly and the first cochlea can attenuate the acoustic vibration substantially, and the fourth amount of energy can be substantially less than the third amount of energy, for example at least about 6 dB, such that the user can localize the sound to the second side. With such a configuration, the user can perceive sounds in stereo.

In addition to providing localization of the sound to the first side or the second side, the first system 10A and the second system 10B can be configured to provide sound localization cues to the user, such that the user can localize the sound to a location within the first side or the second side. A speaker SPK is shown emitting a sound. The sound has a first path SO1 to the first ear E1 and a second path SO2 to the second ear E1. The first pinna can diffract the sound received on first path SO1 so as to provide first spatial localization cue with high frequencies, for example with frequencies above at least about 4 kHz. For example, the first system 10A can transmit sound frequencies within a range from about 60 Hz to at least about 15 kHz, for example up to 20 kHz or more. The second pinna can diffract the sound received on second path SO2 so as to provide second spatial localization cue with high frequencies, for example with frequencies above at least about 4 kHz. For example, the second system 10B can transmit sound frequencies within a range from about 60 Hz to about 15 kHz, for example from about 60 Hz to about 20 kHz or more.

Figure 1A:
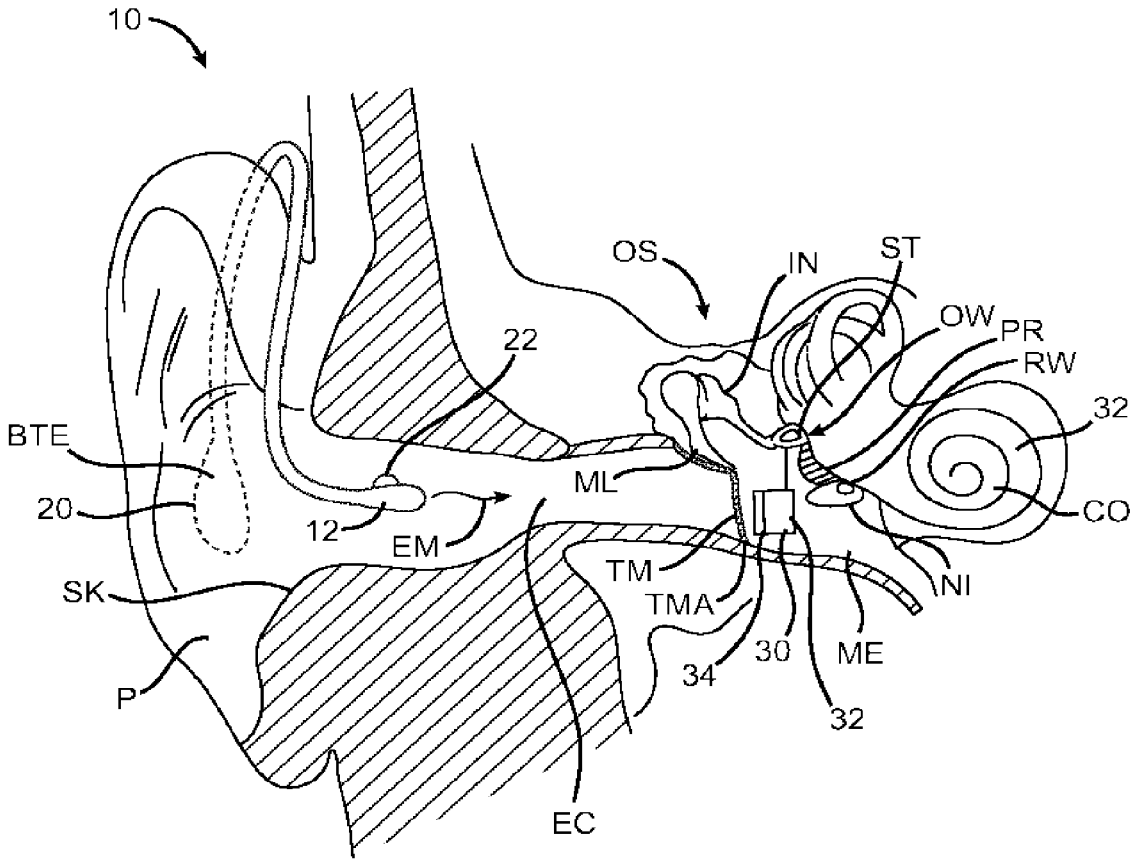
FIG. 1A shows an open canal hearing system comprising a BTE unit and a transducer coupled to a round window of a user with a support, in accordance with embodiments of the present invention.

FIG. 1A shows an open canal hearing system 10, which may comprise components of first system 10A or second system 10B. The hearing system 10 comprises an input assembly 20 and an output assembly 30. The input assembly 20 may comprise a behind the ear (hereinafter "BTE") unit. The output assembly 30 comprises a transducer 32 coupled to bone tissue to transmit the sound to the user.

In many embodiments, the hearing device comprises a photonic hearing device, in which sound is transmitted with photons having energy, such that the signal transmitted to the ear can be encoded with transmitted light.

Hearing system 10 is configured to transmit electromagnetic energy to an output transducer assembly 30 positioned in the middle ear ME of the user. The ear comprises an external ear, a middle ear ME and an inner ear. The external ear comprises a Pinna P and an ear canal EC and is bounded medially by an eardrum TM. Ear canal EC extends medially from pinna P to eardrum TM. Ear canal EC is at least partially defined by a skin SK disposed along the surface of the ear canal. The eardrum TM comprises an annulus TMA that extends circumferentially around a majority of the eardrum to hold the eardrum in place. The middle ear ME is disposed between eardrum TM of the ear and a cochlea CO of the ear. The middle ear ME comprises the ossicles OS to couple the eardrum TM to cochlea CO. The ossicles OS comprise an incus IN, a malleus ML and a stapes ST. The malleus ML is connected to the eardrum TM and the stapes ST is connected to an oval window OW, with the incus IN disposed between the malleus ML and stapes ST. Stapes ST is coupled to the oval window OW so as to conduct sound from the middle ear to the cochlea.

The hearing system 10 includes an input transducer assembly 20 and an output transducer assembly 30 to transmit sound to the user. The BTE unit may comprise many components of system 10 such as a speech processor, battery, wireless transmission circuitry and input transducer assembly 10. Behind the ear unit BTE may comprise many component as described in U.S. Pat. Pub. Nos. 2007/0100197, entitled "Output transducers for hearing systems"; and 2006/0251278, entitled "Hearing system having improved high frequency response", the full disclosures of which are incorporated herein by reference and may be suitable for combination in accordance with some embodiments of the present invention. The input transducer assembly 20 can be located at least partially behind the pinna P, although the input transducer assembly may be located at many sites. For example, the input transducer assembly may be located substantially within the ear canal, as described in U.S. Pub. No. 2006/0251278, the full disclosure of which is incorporated by reference. The input transducer assembly may comprise a blue tooth connection to couple to a cell phone and my comprise, for example, components of the commercially available Sound ID 300, available from Sound ID of Palo Alto, Calif.

The input transducer assembly 20 can receive a sound input, for example an audio sound. With hearing aids for hearing impaired individuals, the input can be ambient sound. The input transducer assembly comprises at least one input transducer, for example a microphone 22. Microphone 22 can be positioned in many locations such as behind the ear, as appropriate. Microphone 22 is shown positioned to detect spatial localization cues from the ambient sound, such that the user can determine where a speaker is located based on the transmitted sound. The pinna P of the ear can diffract sound waves toward the ear canal opening such that sound localization cues can be detected with frequencies above at least about 4 kHz. The sound localization cues can be detected when the microphone is positioned within ear canal EC and also when the microphone is positioned outside the ear canal EC and within about 5 mm of the ear canal opening. The at least one input transducer may comprise a second microphone located away from the ear canal and the ear canal opening, for example positioned on the behind the ear unit BTE. The input transducer assembly can include a suitable amplifier or other electronic interface. In some embodiments, the input may comprise an electronic sound signal from a sound producing or receiving device, such as a telephone, a cellular telephone, a Bluetooth connection, a radio, a digital audio unit, and the like.

In many embodiments, at least a first microphone can be positioned in an ear canal or near an opening of the ear canal to measure high frequency sound above at least about one 4 kHz comprising spatial localization cues. A second microphone can be positioned away from the ear canal and the ear canal opening to measure at least low frequency sound below about 4 kHz. This configuration may decrease feedback to the user, as described in U.S. Pat. Pub. No. US 2009/0097681, the full disclosure of which is incorporated herein by reference and may be suitable for combination in accordance with embodiments of the present invention.

Input transducer assembly 20 includes a signal output source 12 which may comprise a light source such as an LED or a laser diode, an electromagnet, an RF source, or the like. The signal output source can produce an output based on the sound input. Implantable output transducer assembly 30 can receive the output from input transducer assembly 20 and can produce mechanical vibrations in response. Implantable output transducer assembly 30 comprises a transducer and may comprise at least one of a coil, a magnet, a balanced armature, a magnetostrictive element, a photostrictive element, or a piezoelectric element, for example. For example, the implantable output transducer assembly 30 can be coupled an input transducer assembly 20 comprising an elongate flexible support having a coil supported thereon for insertion into the ear canal as described in U.S. Pat. Pub. No. 2009/0092271, entitled "Energy Delivery and Microphone Placement Methods for Improved Comfort in an Open Canal Hearing Aid", the full disclosure of which is incorporated herein by reference and may be suitable for combination in accordance with some embodiments of the present invention. Alternatively or in combination, the input transducer assembly 20 may comprise a light source coupled to a fiber optic, for example as described in U.S. Pat. Pub. No. 2006/0189841 entitled, "Systems and Methods for Photo-Mechanical Hearing Transduction", the full disclosure of which is incorporated herein by reference and may be suitable for combination in accordance with some embodiments of the present invention. The light source of the input transducer assembly 20 may also be positioned in the ear canal, and the output transducer assembly and the BTE circuitry components may be located within the ear canal so as to fit within the ear canal. When properly coupled to the subject's hearing transduction pathway, the mechanical vibrations caused by output transducer 30 can induce neural impulses in the subject which can be interpreted by the subject as the original sound input.

The implantable output transducer assembly 30 can be configured to couple to the cochlea of the inner ear in many ways, so as to induce neural impulses which can be interpreted as sound by the user. The coupling may occur with at least a portion of the transducer coupled to bone, for example affixed to bone, such that the vibration originates near the cochlea such that sound transmitted to a second cochlea is inhibited substantially by tissue as described above. The implantable output transducer assembly 30 can be supported with a substantially fixed structure of the ear, such that vibration of the vibratory structures of the ear is not inhibited by mass of assembly 30. For example, output transducer assembly 30 may be supported on the promontory PM by a support, housing, mold, or the like shaped to conform with the shape of the promontory PM. The transducer assembly may be affixed with a tissue graft to skin supported with rigid bony structure that defines at least a portion of the ear canal. The transducer assembly 30 can be supported with many of the additional substantially fixed structures of the middle ear such as the bone that defines the round window niche.

FIG. 1A1 shows an input assembly 20 of system 10 comprising an ear canal module (hereinafter "ECM"). The ECM may comprise many of the components of the BTE unit and vice-versa. The ECM may be shaped from a mold of the user's ear canal EC. Circuitry (Circ.) can be coupled to microphone 22. The circuitry may comprise a sound processor. The ECM may comprise an energy storage device PS configured to store electrical energy. The storage device may comprise many known storage devices such at least one of a battery, a rechargeable batter, a capacitor, a supercapacitor, or electrochemical double layer capacitor (EDLC). The ECM can be removed, for example for recharging or when the user sleeps. The ECM may comprise a channel 29 to pass air so as to decrease occlusion. Although air is passed through channel 29, feedback can be decrease due to coupling of the transducer or electrode array directly to tissue.

The energy storage device PS may comprise a rechargeable energy storage device that can be recharged in many ways. For example, the energy storage device may be charged with a plug in connector coupled to a super capacitor for rapid charging. Alternatively, the energy storage device may be charged with an inductive coil or with a photodetector PV. The photodetector detector PV may be positioned on a proximal end of the ECM such that the photodetector is exposed to light entering the ear canal EC. The photodetector PV can be coupled to the energy storage device PS so as to charge the energy storage device PS. The photodetector may comprise many detectors, for example black silicone as described above. The rechargeable energy storage device can be provided merely for convenience, as the energy storage device PS may comprise batteries that the user can replace when the ECM is removed from ear canal.

The photodetector PV may comprise at least one photovoltaic material such as crystalline silicon, amorphous silicon, micromorphous silicon, black silicon, cadmium telluride, copper indium gallium selenide, and the like. In some embodiments, the photodetector PV may comprise black silicon, for example as described in U.S. Pat. Nos. 7,354,792 and 7,390,689 and available under from SiOnyx, Inc. of Beverly, Mass. The black silicon may comprise shallow junction photonics manufactured with semiconductor process that exploits atomic level alterations that occur in materials irradiated by high intensity lasers, such as a femto-second laser that exposes the target semiconductor to high intensity pulses as short as one billionth of a millionth of a second. Crystalline materials subject to these intense localized energy events may under go a transformative change, such that the atomic structure becomes instantaneously disordered and new compounds are "locked in" as the substrate re-crystallizes. When applied to silicon, the result can be a highly doped, optically opaque, shallow junction interface that is many times more sensitive to light than conventional semiconductor materials. Photovoltaic transducers for hearing devices are also described in detail in U.S. Patent Applications Nos. 61/073,271, entitled "Optical Electro-Mechanical Hearing Devices With Combined Power and Signal Architectures"; and 61/073,281, entitled "Optical Electro-Mechanical Hearing Devices with Separate Power and Signal", the full disclosures of which have been previously incorporated herein by reference and may be suitable for combination in accordance with some embodiments as described herein.

The output transducer assembly and anchor structure can be shaped in many ways to fit within the middle ear during implantation and affix to structures therein to couple to the cochlea. For example, the output transducer assembly may comprise a cross sectional size to pass through an incision in the eardrum TM and annulus TMA, such that bone that defines the ear canal can remain intact. The annulus TMA can be supported by a sulcus SU formed in the bony portion of the ear disposed between the external ear and middle ear. The eardrum can be incised along the annulus to form a flap of eardrum, a portion of which eardrum may remain connected to the user and placed on the margin of the ear canal when the transducer assembly 30 is positioned in the middle ear. Flap can be positioned after the transducer is positioned in the middle ear. The transducer assembly may comprise at least a portion shaped to fit within a round window niche. Alternatively or in combination, transducer assembly 30 may comprise a rounded concave portion 30R shaped to receive a rounded promontory of the middle ear.

The anchor structure can be configured to attach to many structures of the middle ear. For example, the anchor structure can be configured to affix to bone of the promontory. Alternatively or in combination, the anchor structure may be configured to couple to a bony lip near the round window.

The BTE may comprise many of the components of the ECM, for example photodetector PV, energy storage device PS, the processor and circuitry, as described above.

FIGS. 1B1 and 1B2 show a schematic illustration of the transducer 32 of the output transducer assembly 30 coupled to the cochlear fluid with a support 32S. Output transducer 32 vibrates the fluid of the cochlea such that sound is perceived by the user. The output transducer assembly also comprises at least one transducer 34 configured to receive electromagnetic energy transmitted through the eardrum TM, for example at least one of a coil, a photodetector, or a photostrictive material. The at least one transducer 34 may be coupled to the output transducer 32 with circuitry, such that output transducer 32 vibrates in response to electromagnetic energy transmitted through eardrum TM. Output transducer assembly 30 may comprise an anchor structure 36 configured to affix the output transducer assembly to a substantially fixed structure of the ear, such as promontory PR. The anchor structure 36 may comprise a biocompatible structure configured to receive a tissue graft, for example, and may comprise at least one of a coating, a flange or holes for tissue integration. The anchor structure 36 can be affixed to the bone tissue such that the location of the assembly remains substantially fixed when sound transducer 32 is acoustically coupled to the vibratory structures of the ear. For example, a small hole can be drilled in the promontory PR and the anchor screwed into the hole to couple to the cochlear bone.

In some embodiments, the at least one detector 34 may comprise output transducer 32. For example the photodetector may comprise a photostrictive material configured to vibrate in response to light energy.

The transducer 32 may comprise at least one of a coil, a magnet, the coil and the magnet, a piezoelectric transducer, a photostrictive transducer, a magnetostrictive transducer or a balanced armature transducer. For example, transducer 32 may comprise the balanced armature transducer. The balanced armature transducer may comprise a reed 32R. The reed 32R can be coupled to the support 32S with an extension structure extending therebetween, for example a post 32P.

The support 32S can be configured in many ways to couple to the cochlea fluid. For example, the support may comprise a rigid biocompatible material sized to fit in a fenestration formed in the cochlear bone or in the footplate of the stapes ST. The biocompatible material may comprise many materials, for example hydroxyapatite or titanium. The support comprising the rigid material may be placed in the fenestration as a plug, and contact the cochlear fluid. The support may comprise a thin flexible membrane configured contact the cochlear fluid to couple the transducer to the cochlear fluid.

The stapes may be configured in many ways to couple to the transducer to the cochlear fluid. For example, the fenestration may be formed in the footplate to couple the cochlear fluid to the support 32S. One or more crus of the stapes may be removed. For example one crus of the stapes may be removed such that the other crus remains intact to conduct sound from the eardrum to the cochlea.

The at least one detector 34 may comprise at least one photodetector as noted above. For example, the at least one photodetector may comprise a first photodetector 132 and a second photodetector 134. The first photodetector 132 can be sensitive to a first at least one wavelength of light, and the second photodetector 134 can be sensitive to a second at least one wavelength of light. The first photodetector may transmit substantially the second at least one wavelength of light such that the first photodetector can be positioned over the second photodetector. The first photodetector 132 and the second photodetector 134 may be coupled to the movement transducer 140 with an opposite polarity such that the transducer urges the first component toward the second component so as to decrease the length in response to the first at least one wavelength of light and such that the transducer urges the first component away from the second component so as to increase the length in response to the second at least one wavelength of light.

The first light output signal and the second light output signal can drive the movement transducer in a first direction and a second direction, respectively, such that the cross sectional size of both detectors positioned on the assembly corresponds to a size of one of the detectors. The first detector may be sensitive to light comprising at least one wavelength of about 1 um, and the second detector can be sensitive to light comprising at least one wavelength of about 1.5 um. The first detector may comprise a silicon (hereinafter "Si") detector configured to absorb substantially light having wavelengths from about 700 to about 1100 nm, and configured to transmit substantially light having wavelengths from about 1400 to about 1700 nm, for example from about 1500 to about 1600 nm. For example, the first detector can be configured to absorb substantially light at 904 nm. The second detector may comprise an Indium Galium Arsenide detector (hereinafter "InGaAs") configured to absorb light transmitted through the first detector and having wavelengths from about 1400 to about 1700 nm, for example from about 1500 to 1600 nm, for example 1550 nm. In a specific example, the second detector can be configured to absorb light at about 1310 nm. The cross sectional area of the detectors can be about 4 mm squared, for example a 2 mm by 2 mm square for each detector, such that the total detection area of 8 mm squared exceeds the cross sectional area of 4 mm squared of the detectors in the ear canal. The detectors may comprise circular detection areas, for example a 2 mm diameter circular detector area.

The first photodetector 132 and the second photodetector 134 may comprise at least one photovoltaic material such as crystalline silicon, amorphous silicon, micromorphous silicon, black silicon, cadmium telluride, copper indium gallium selenide, indium gallium arsenide and the like. In some embodiments, at least one of photodetector 132 or photodetector 132 may comprise black silicon, for example as described in U.S. Pat. Nos. 7,354,792 and 7,390,689 and available under from SiOnyx, Inc. of Beverly, Mass. The black silicon may comprise shallow junction photonics manufactured with semiconductor process that exploits atomic level alterations that occur in materials irradiated by high intensity lasers, such as a femto-second laser that exposes the target semiconductor to high intensity pulses as short as one billionth of a millionth of a second. Crystalline materials subject to these intense localized energy events may under go a transformative change, such that the atomic structure becomes instantaneously disordered and new compounds are "locked in" as the substrate re-crystallizes. When applied to silicon, the result can be a highly doped, optically opaque, shallow junction interface that is many times more sensitive to light than conventional semiconductor materials. Photovoltaic transducers for hearing devices are also described in detail in U.S. patent application Ser. No. 12/486,100, filed Jun. 17, 2009, entitled "Optical Electro-Mechanical Hearing Devices With Combined Power and Signal Architectures"; and Ser. No. 12/486,116, filed Jun. 17, 2009, entitled "Optical Electro-Mechanical Hearing Devices with Separate Power and Signal", the full disclosures of which are incorporated herein by reference and may be suitable for combination in accordance with some embodiments as described herein.

The electromagnetic signal transmitted through the eardrum TM to the assembly 30 may comprise one or more of many kinds of signals. For example, the signal transmitted through the eardrum TM may comprise a pulse width modulated signal. The pulse width modulated signal may comprise a first pulse width modulated signal of at least one first wavelength of light from a first source and the second pulse width modulated signal of a second at least one wavelength of light from a second source. The first at least one wavelength of light may be received by a first detector, and the second at least one wavelength of light may be received by the second detector.

The components of the output assembly 30 may comprise many biocompatible materials, for example hydroxyapatite, titanium, polymer, or cobalt chrome, and many combinations thereof. The biocompatible material may comprise a material to promote bone growth.

The transducer 32H may be contained within a biocompatible housing 32H.

The assembly 30 may be detachable from the support 32S such that the assembly can be removed for MRI imaging of the patient, as described in U.S. App. No. 61/219,289 filed on Jun. 22, 2009, entitled "Round Window Coupled Hearing Systems and Methods", the full disclosure of which is incorporated by reference and may be suitable for combination in accordance with some embodiments described herein. The support 32S may be affixed to the bone tissue when the assembly 30 is removed.

Figure 2A:
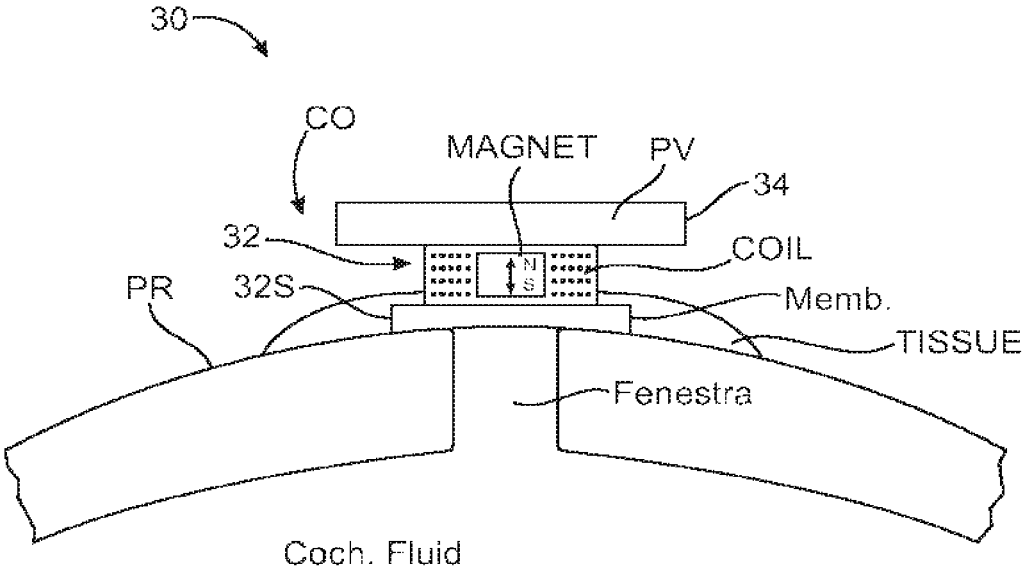
FIG. 2A shows a schematic illustration of a transducer assembly with a support coupled to cochlear fluid with a fenestration in the cochlear bone, in accordance with embodiments of the present invention.

FIG. 2A shows a schematic illustration of transducer assembly 30 with a support 32S in contact with cochlear fluid. The support 32S may comprise a thin flexible membrane. The fenestration may be formed in cochlear bone, for example on the promontory of the cochlea. The transducer 32 may comprise many of the transducers described above. For example transducer 32 may comprise a coil and a magnet 32M. The magnet 32M may be positioned in a channel to move as indicated by the arrows. The magnet 32M may comprise inertial mass that coil and membrane move in opposition to the coil so as to vibrate the membrane in response to the opposing inertial of the magnet. Alternatively, the magnet may be connected to the membrane and vibrate with the membrane, such that the magnet and membrane move opposite the coil and at least one detector 34. The at least one detector 34, as described above, is coupled to the transducer 32. Tissue may be positioned over the membrane, for example surgically positioned, such that the membrane seals the fenestration and the assembly 30 is held in place. Alternatively or in combination, the assembly 30 may comprise anchor 36 as described above. The assembly 30 may be detachable from the support, as described above.

FIG. 2A1 shows a schematic illustration of a transducer assembly as in FIG. 2A in which the support 32S comprises a structure 32SP extending from an upper surface of the cochlear bone into the fenestra to couple to the endostium. The support 32S may comprise an upper flange portion sized larger than the fenestra and the structure 32SP may have a maximum cross sectional size, for example a diameter, sized smaller than the fenestra such that the structure 32SP extends from the upper surface of the cochlear bone to the lower surface of the cochlear bone in contact with the endostium, such that vibration of the magnet 32M is coupled to the cochlear fluid with vibration of the elongate structure of the support coupled to the endostium. The support 32S may comprise a first upper component comprising the flange sized larger than the fenestra and a second lower component sized for placement in the fenestra. Alternatively, the support 32S may comprise a single piece of material comprising the upper flange portion and the lower elongate portion.

FIG. 2B shows a schematic illustration of transducer assembly 30 in which the transducer 32 comprising a magnet with a biocompatible housing 32H. The magnet is positioned on support 32S. Support 32S contacts cochlear fluid so as to couple the magnet to the cochlear fluid. The support 32S may comprise tissue, for example graft tissue such as fascia or vein tissue. The support is positioned over a fenestration formed in the footplate of the stapes. A similar assembly can be positioned over a fenestration in cochlear bone, for example on the promontory.

FIG. 2B1 shows magnet 32M comprising a pair of opposing magnets suitable for use with many transducers as described herein. The pair of opposing magnets may comprise a fisrt magnet 32M1 and a second magnet 32M2. An adhesive 32A may adhere the first magnet to the second magnet with the magnetic field of the first magnet opposite the magnetic field of the second magnet. The pair of opposing magnets may decrease sensitivity of the transducer assembly to external electromagnetic fields, for example transient electromagnetic fields such as 60 Hz noise from power sources and, for example, magnetic fields from MRI machines.

Figure 3A:
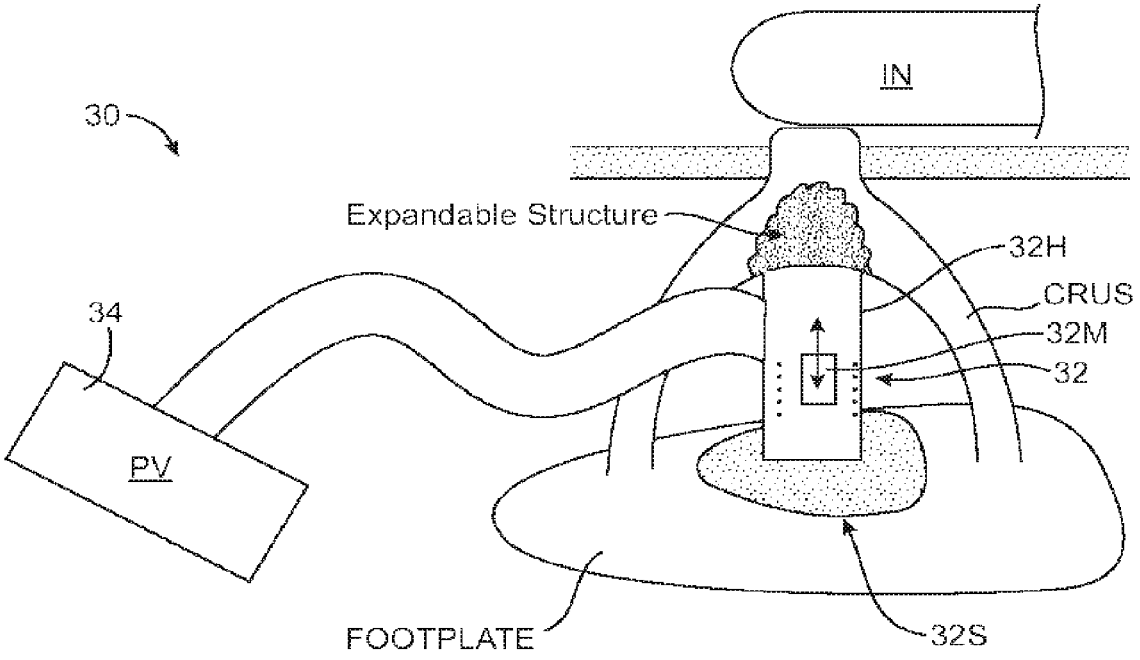
FIG. 3A shows a transducer assembly comprising an expandable structure positioned at least partially between crura of the stapes, in accordance with embodiments of the present invention.
Figure 3B:
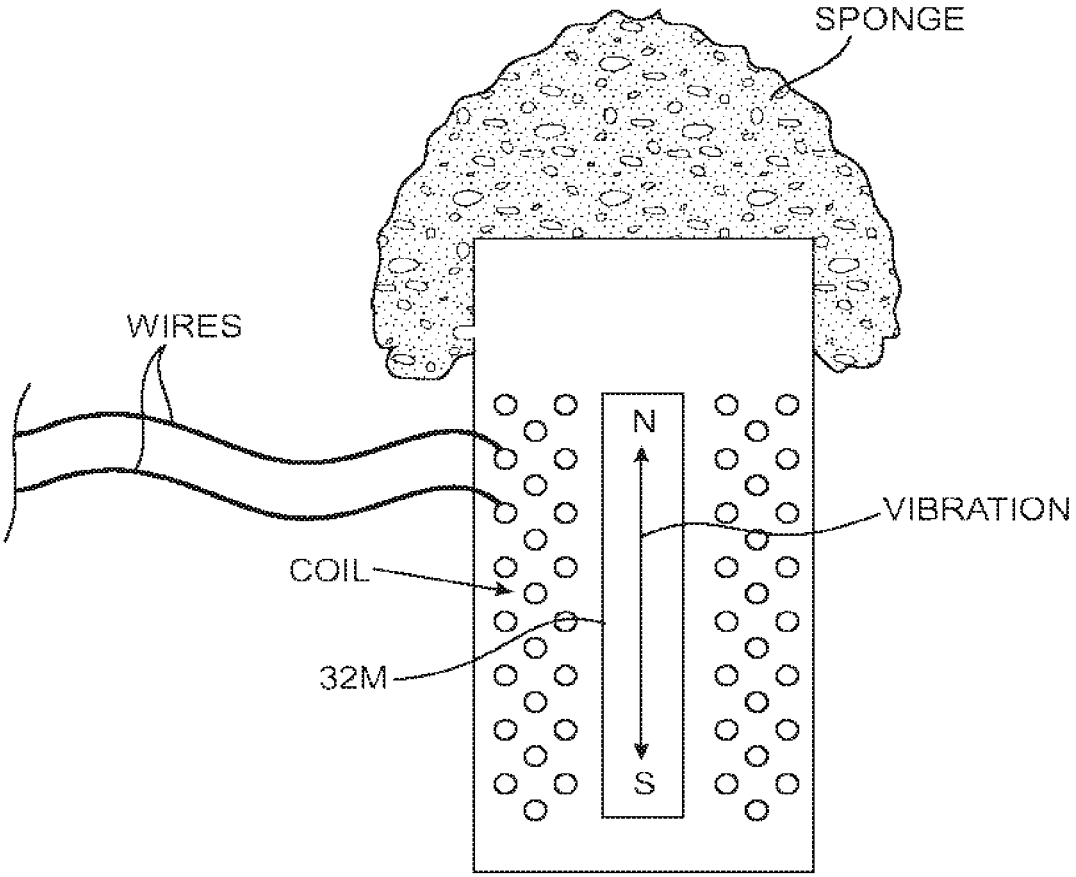
FIG. 3B shows transducer assembly of FIG. 3A configured for placement at least partially between the crura of the stapes.

FIG. 3A shows transducer assembly 30 comprising an expandable structure positioned at least partially between crura of the stapes, and FIG. 3B shows transducer assembly of FIG. 3A configured for placement at least partially between the crura of the stapes. The assembly 30 comprises a transducer 32, as described above. The transducer 32 can be contained within a housing 32H, as described above. The expandable structure may be positioned on portion of the housing 32H. The transducer can be configured to vibrate the stapes. The transducer can be contained at least partially within the housing The expandable structure may be disposed on a portion of the housing. The expandable structure and the housing can be sized for placement at least partially between crura of the stapes to couple the transducer to the stapes.

At least a portion of the housing is sized to contact a footplate of the stapes when the expandable structure and the housing are positioned at least partially between the crura. Alternatively, a fenestration may be formed in the stapes foots plate and the housing may contact the support, as described above.

The expandable structure can be configured to contact the stapes between the crura. The expandable structure may comprise at least one of an expandable material, a spring, a sponge, a water absorbent material or a hydrogel. The expandable structure may comprise a mechanical impedance so as to couple vibration to the cochlear fluid, and may also provide at least partial deformation with static forces so as to provide at least some strain relief, for example. In many embodiments, the impedance of the expandable structure at audio frequencies is greater than the impedance of the cochlear fluid, which is approximately 100,000 Pa-s/m (Pascal-seconds per meter), so as to couple efficiently mechanical vibration of the transducer to the cochlea. For example, water absorbent materials such as sponges and hydrogels can provide at least some static deformation and provide acoustic impedance greater than the cochlear fluid, although many expandable structures as described herein may also be used.

The at least one photodetector can be coupled to the transducer as described above so as to vibrate the stapes. The at least one photodetector can be electrically coupled to the transducer with an electrical conductor sized to position the at least one photodetector on the promontory when the expandable material and the housing are positioned at least partially between the crura.

The transducer 32 may comprise at least one of a coil, a magnet, the coil and the magnet, a piezoelectric transducer, a photostrictive transducer or a balanced armature transducer. For example, the transducer may comprises the coil and the magnet, and the coil and the magnet can be sized for placement at least partially between the crura.

The transducer may comprise the magnet as described above, and the magnet can be sized for placement at least partially between the crura. The coil may be sized for placement in an ear canal of the user as described above so as to couple to the magnet.

Figure 4:
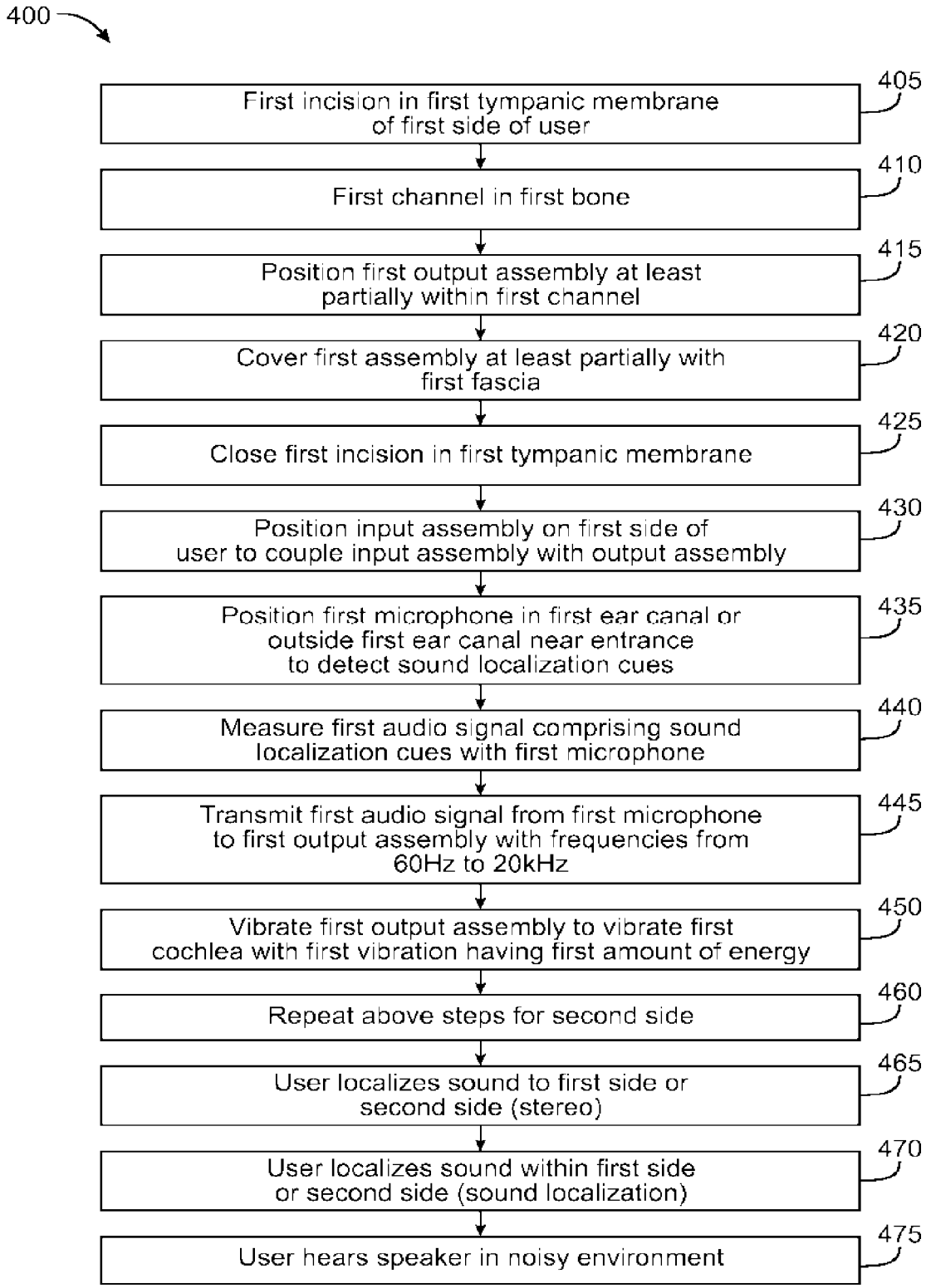
FIG. 4 shows a method of transmitting sound to a user with side specificity and sound localization cues, in accordance with embodiments of the present invention.

FIG. 4 shows a method of transmitting sound to a user with side specificity and sound localization cues to locate sound within a side, for example. A step 405 make a first incision in a first tympanic membrane of a first side of the user. A step 410 makes a first channel in first bone, in which the channel may extend to the cochlear fluid. The bone may comprise cochlear bone. A step 415 positions the first output assembly at least partially within the channel. A step 420 covers the first output assembly at least partially with first fascia. A step 425 closes the first incision in the first tympanic membrane. A step 430 positions the input assembly on the first side of the user to couple the input assembly with the implanted output assembly. A step 435 positions a first microphone in a first ear canal or the first ear canal near the ear canal entrance to detect the sound localization cues, as described above. A step 440 measures a first audio signal comprise a sound localization cues on a with the first microphone. A step 445 transmits the first audio signal from the first microphone to the first output assembly with frequencies from about 60 Hz to about 20 kHz. A step 450 vibrates the first output assembly with a first vibration having the first amount of energy. A step 460 repeats the above steps for the second system positioned on the second side, as described above. With a step 470, the user localizes sound to the first side or the second side with stereo. With a step 475, the user localizes the sound within the first side or the second side. With a step 475, the user hears a speaker such as a person in a noisy environment, for example based on the sound localization cues.

The sound processor comprising a tangible medium as described above can be configured with software comprising instructions of a computer program embodied thereon implant many of the steps described above. The surgeon may implant the output assembly and the user may position the input assembly, as noted above.

It should be appreciated that the specific steps illustrated in FIG. 4 provides a particular method transmitting a sound to a user, according to some embodiments of the present invention. Other sequences of steps may also be performed according to alternative embodiments. For example, alternative embodiments of the present invention may perform the steps outlined above in a different order. Moreover, the individual steps illustrated in FIG. 4 may include multiple sub-steps that may be performed in various sequences as appropriate to the individual step. Furthermore, additional steps may be added or removed depending on the particular applications. One of ordinary skill in the art would recognize many variations, modifications, and alternatives.

EXPERIMENTAL

Based on the teachings described herein, a person of ordinary skill in the art can conduct experimental studies to determine empirically the configuration of the support to couple the transducer to the cochlear fluid, such that the user can localize sound to the left side or the right side, and such that the user can detect sound localization cues to determine a location of the sound within one of the sides. For example, experiments can be conducted to determine attenuation of sound of the second cochlea relative to the cochlea with the output assembly coupled to mastoid bone or to cochlear bone so as to determine suitable configurations of the fenestration and support.

While the exemplary embodiments have been described in some detail, by way of example and for clarity of understanding, those of skill in the art will recognize that a variety of modifications, adaptations, and changes may be employed. Hence, the scope of the present invention should be limited solely by the appended claims and the full scope of the equivalents thereof.

What is claimed is:

1. A device to transmit a sound to a user having a middle ear and a cochlea comprising a cochlear fluid, the device comprising:

an input assembly configured to receive a sound input; and an output assembly comprising a support and a transducer, wherein the support is configured to extend over and to cover a fenestration in the cochlear bone tissue, and wherein the transducer is configured to be positioned at or over the support and over the fenestration to vibrate the support and in turn to vibrate the cochlear fluid to transmit the sound to the user.

2. The device of claim 1 wherein the output assembly is configured to couple to the cochlear fluid with the support contacting the cochlear fluid.

3. The device of claim 1 wherein the support is configured to contact the cochlear fluid through the fenestration formed in a footplate of the stapes or on a promontory of the cochlea.

4. The device of claim 1 wherein the support comprises a rigid material sized to fit within the fenestration formed in the stapes and wherein the rigid material comprises a biocompatible material configured to integrate with bone tissue of the stapes.

5. The device of claim 4 wherein the support comprises a length and a width, wherein the width is sized to extend over and cover a diameter of the fenestration and wherein the length is sized to extend at least across a thickness of the foot plate of the stapes from the middle ear to an oval window of the cochlea.

6. The device of claim 1 wherein the support comprises a thin flexible membrane configured to extend across the fenestration to seal the cochlea and vibrate the cochlear fluid.

7. The device of claim 1 wherein the transducer comprises at least one of a coil, a magnet, the coil and the magnet, a piezoelectric transducer, a photostrictive transducer, a magnetostrictive transducer or a balanced armature transducer.

8. The device of claim 7 wherein the transducer comprises the balanced armature transducer and wherein the balanced armature transducer is configured for placement on a promontory of the user and is coupled to the support through a structure extending from the balanced armature transducer to the support.

9. The device of claim 7 wherein the transducer comprises the magnet and the coil wherein the magnet is configured to couple to a flexible support in contact with the cochlear fluid to vibrate the cochlea fluid.

10. The device of claim 1 wherein the input assembly is configured to transmit an electromagnetic signal to the output assembly to vibrate the cochlear fluid in response to the sound input.

11. The device of claim 10 wherein the electromagnetic signal comprises a magnetic field from a coil and wherein the output assembly comprises a magnet configured to vibrate the cochlear fluid in response to the magnetic field from the coil.

12. The device of claim 11 wherein the coil is configured for placement in an ear canal of the user.

13. The device of claim 10 wherein the electromagnetic signal comprises light energy and the input assembly comprises at least one light source configured to emit the light energy and wherein the output assembly comprises at least one photodetector to receive the light energy and coupled to the transducer to vibrate the cochlear fluid in response to the light energy.

14. The device of claim 13 wherein the at least one photodetector comprises at least one of photovoltaic material.

15. The device of claim 14 wherein the at least one photovoltaic material comprising at least one of crystalline silicon, amorphous silicon, micromorphous silicon, black silicon, cadmium telluride, copper indium gallium selenide or indium gallium arsenide.

16. The device of claim 13 wherein the at least one photodetector comprises at least two photo detectors.

17. The device of claim 16 wherein the at least two photodetectors are coupled to the transducer with an opposite polarity.

18. A method of transmitting a sound to a user having a middle ear and a cochlea comprising a cochlear fluid, the method comprising:

making a channel or fenestration in a cochlea bone;

positioning a support over the fenestration; and positioning a transducer at or over the support to vibrate the support and in turn vibrate the cochlear fluid to transmit the sound to the user in response to a sound input.

19. The method of claim 18, further comprising positioning the support at least partially within the fenestration in a cochlea bone.

20. A device for implantation in a middle ear of a user, the middle ear having a stapes, the device comprising:

a housing configured to extend over and to cover a fenestration in the cochlear bone tissue, the housing comprising a support;

a transducer configured to vibrate the stapes, the transducer being contained at least partially within the housing and configured to be positioned at or over the support and over the fenestration to vibrate the support and in turn vibrate the cochlear fluid to transmit sound to the user; and an expandable structure disposed on a portion of the housing, the expandable structure and the housing sized for placement at least partially between crura of the stapes to couple the transducer to the stapes.

21. The device of claim 20, wherein at least a portion of the housing is sized to contact a footplate of the stapes when the expandable structure and the housing are positioned at least partially between the crura.

22. The device of claim 21, wherein the expandable structure comprises at least one of an expandable material, a spring, a sponge, a water absorbent material or a hydrogel.

* * * * *